US005976779A

United States Patent [19]

Hioki

[11] Patent Number: 5,976,779

[45] Date of Patent: Nov. 2, 1999

[54] SILVER HALIDE PHOTOGRAPHIC MATERIAL

[75] Inventor: Takanori Hioki, Kanagawa, Japan

[73] Assignee: Fuji Photo Film Co., Ltd., Kanagawa, Japan

[21] Appl. No.: 08/971,124

[22] Filed: Nov. 20, 1997

[30] Foreign Application Priority Data

Nov. 28, 1996 [JP] Japan ..... 8-317837

[51] Int. Cl.[6] ..... G03C 1/14

[52] U.S. Cl. ..... 430/583; 430/581; 430/584; 430/585; 430/611

[58] Field of Search ..... 430/583, 581, 430/584, 585, 611

[56] References Cited

U.S. PATENT DOCUMENTS

| | | | |
|---|---|---|---|
| 3,424,586 | 1/1969 | Gotze . | |
| 5,254,456 | 10/1993 | Yashimata et al. | 430/611 |
| 5,290,673 | 3/1994 | Nishikawa | 430/567 |
| 5,597,687 | 1/1997 | Dobles et al. . | |

*Primary Examiner*—Thorl Chea

*Attorney, Agent, or Firm*—Sughrue, Mion, Zinn, Macpeak & Seas, PLLC

[57] ABSTRACT

A silver halide photographic material comprising a support having provided thereon at least one silver halide emulsion layer, wherein silver halide grains of said emulsion layer are reduction sensitized and contain at least one compound represented by the following formula (I):

(I)

wherein A represents a divalent linking group having at least one atom other than a carbon atom; $Z_1$ represents an atomic group necessary for forming a 5- or 6-membered nitrogen-containing heterocyclic ring; $L_1$ and $L_2$ each represents a methine group; $p_1$ represents 0 or 1; $M_1$ represents a counter ion for balancing a charge; $m_1$ represents a number of from 0 to 10 necessary for neutralizing a charge in the molecule; and Q represents a group necessary to form a methine dye.

7 Claims, No Drawings

SILVER HALIDE PHOTOGRAPHIC MATERIAL

FIELD OF THE INVENTION

The present invention relates to a silver halide photographic material and, more particularly, to a silver halide photographic material which is high sensitive, generates less fog and is excellent in storage stability.

BACKGROUND OF THE INVENTION

Every endeavor has been made for higher sensitization and reduction of residual colors after processing of a silver halide photographic material. It is known that a sensitizing dye which is used for spectral sensitization largely affects capabilities of a silver halide photographic material. A trace of structural difference of a sensitizing dye largely affects photographic capabilities such as sensitivity, fog and storage stability but it is difficult to foresee its effect. Many engineers have hitherto synthesized various kinds of sensitizing dyes and endeavored to investigate photographic capabilities thereof but it is not possible to know photographic capabilities in advance yet.

Further, a trial of reduction sensitization for higher sensitization of a silver halide photographic material has been studied heretofore. Various compounds are disclosed in many patent as a useful reduction sensitizer, for example, tin compounds are disclosed in U.S. Pat. No. 2,487,850, polyamine compounds in U.S. Pat. No. 2,512,925, and thiourea dioxide based compounds in British Patent 789, 823. Further, in *Photographic Science and Engineering*, Vol. 23, p. 113 (1979), comparisons of natures of silver nuclei formed according to various reduction sensitizing methods are described and dimethylamineborane, stannous chloride, hydrazine, and methods of high pH ripening and low pAg ripening have been employed. Reduction sensitizing methods are also disclosed in U.S. Pat. Nos. 2,518,698, 3,201, 254, 3,411,917, 3,779,777 and 3,930,867. Not only the selection of reduction sensitizers but contrivances of reduction sensitizing methods are disclosed in JP-B-57-33572 and JP-B-58-1410 (the term "JP-B" as used herein means an "examined Japanese patent publication").

However, it has been found from the studies of the present inventors that when reduction sensitized silver halide grains are spectrally sensitized by the adsorption of sensitizing dyes, in particular, when spectral sensitization is conducted in green and red regions, it has been extremely difficult to obtain sufficient spectral sensitivity without being accompanied by disadvantageous reactions on photographic capabilities (e.g., the increase of fog).

Moreover, a method of adsorbing a sensitizing dye at high temperature (50° C. or more) for preventing the desorption of a sensitizing dye from silver halide grains in a photographic material (in particular, under high humidity conditions), and a method of adsorbing a sensitizing dye before chemical sensitization for high sensitization are widely known, but if these methods are applied for adsorbing a spectral sensitizing dye in green and red regions onto a reduction sensitized emulsion, fog is markedly increased.

From the above-described reasons, techniques of spectrally sensitizing a reduction sensitized silver halide grains in a high sensitive state and without causing malefic effects such as the increase of fog have been demanded.

SUMMARY OF THE INVENTION

An object of the present invention is to provide a silver halide photographic material which is high sensitive, generates less fog and is excellent in storage stability.

As a result of eager investigations, the above object of the present invention has been attained by the following (1) to (4) means.

(1) A silver halide photographic material comprising a support having provided thereon at least one silver halide emulsion layer, wherein silver halide grains of said emulsion layer are reduction sensitized and contain at least one compound represented by the following formula (I):

(I)

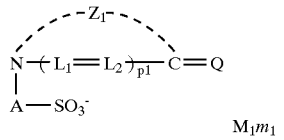

$M_1m_1$ wherein A represents a divalent linking group having at least one atom other than a carbon atom; $Z_1$ represents an atomic group necessary for forming a 5- or 6-membered nitrogen-containing heterocyclic ring; $L_1$ and $L_2$ each represents a methine group; $P_1$ represents 0 or 1; $M_1$ represents a counter ion for balancing a charge; $m_1$ represents a number of from 0 to 10 necessary for neutralizing a charge in the molecule; and Q represents a group necessary to form a methine dye.

(2) The silver halide photographic material as described in (1), wherein A in the compound represented by formula (I) is represented by $A_1$ or $A_2$:

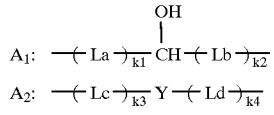

wherein La, Lb, Lc and Ld each represents a methylene group; $k_1$, $k_2$, $k_3$ and $k_4$ each represents 0 or an integer of from 1 to 10; and Y represents an oxygen atom or a sulfur atom.

(3) The silver halide photographic material as described in (1) or (2), wherein said material contains at least one compound represented by the following formula (XX), (XXI) or (XXII):

(XX)

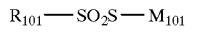

(XXI)

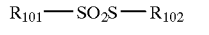

(XXII)

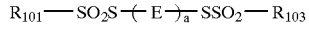

wherein $R_{101}$, $R_{102}$ and $R_{103}$ each represents an aliphatic group, an aromatic group or a heterocyclic group; $M_{101}$ represents a cation; E represents a divalent linking group, and a represents 0 or 1.

(4) The silver halide photographic material as described in (1), (2) or (3), wherein said material contains a transparent magnetic recording layer.

DETAILED DESCRIPTION OF THE INVENTION

Compounds for use in the present invention are described in detail below.

Examples of 5- or 6-membered nitrogen-containing heterocyclic rings represented by $Z_1$ in formula (I) include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g., 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus, and a pyrimidine nucleus.

Of these, preferred are a benzoxazole nucleus, a benzothiazole nucleus, a benzimidazole nucleus, and a quinoline nucleus, more preferred are a benzoxazole nucleus and a benzothiazole nucleus, and particularly preferred is a benzothiazole nucleus.

Assuming that the substituent on $Z_1$ is V, the substituent represented by V is not particularly limited. Examples of V include, for example, a halogen atom (e.g., chlorine, bromine, iodine, fluorine), a mercapto group, a cyano group, a carboxyl group, a phosphoric acid group, a sulfo group, a hydroxyl group, a carbamoyl group (hereinafter, "a carbamoyl group" means a carbamoyl group which may have a substituent), for example, a carbamoyl group having from 1 to 10, preferably from 2 to 8, more preferably from 2 to 5, carbon atoms (e.g., methylcarbamoyl, ethylcarbamoyl, morpholinocarbonyl), a sulfamoyl group (which may be substituted), for example, a sulfamoyl group having from 0 to 10, preferably from 2 to 8, more preferably from 2 to 5, carbon atoms (e.g., methylsulfamoyl, ethylsulfamoyl, piperidinosulfonyl), a nitro group, an alkoxyl group (which may be substituted), for example, an alkoxyl group having from 1 to 20, preferably from 1 to 10, more preferably from 1 to 8, carbon atoms (e.g., methoxy, ethoxy, 2-methoxyethoxy, 2-phenylethoxy), an aryloxy group (which may be substituted), for example, an aryloxy group having from 6 to 20, preferably from 6 to 12, more preferably from 6 to 10, carbon atoms (e.g., phenoxy, p-methylphenoxy, p-chlorophenoxy, naphthoxy), an acyl group (which may be substituted), for example, an acyl group having from 1 to 20, preferably from 2 to 12, more preferably from 2 to 8, carbon atoms (e.g., acetyl, benzoyl, trichloroacetyl), an acyloxy group (which may be substituted), for example, an acyloxy group having from 1 to 20, preferably from 2 to 12, more preferably from 2 to 8, carbon atoms (e.g., acetyloxy, benzoyloxy), an acylamino group (which may be substituted), for example, an acylamino group having from 1 to 20, preferably from 2 to 12, more preferably from 2 to 8, carbon atoms (e.g., acetylamino), a sulfonyl group (which may be substituted), for example, a sulfonyl group having from 1 to 20, preferably from 1 to 10, more preferably from 1 to 8, carbon atoms (e.g., methanesulfonyl, ethanesulfonyl, benzenesulfonyl), a sulfinyl group (which may be substituted), for example, a sulfinyl group having from 1 to 20, preferably from 1 to 10, more preferably from 1 to 8, carbon atoms (e.g., methanesulfinyl, benzenesulfinyl), a sulfonylamino group (which may be substituted), for example, a sulfonylamino group having from 1 to 20, preferably from 1 to 10, more preferably from 1 to 8, carbon atoms (e.g., methanesulfonylamino, ethanesulfonylamino, benzenesulfonylamino), an amino group, a substituted amino group (which may be substituted), for example, a substituted amino group having from 1 to 20, preferably from 1 to 12, more preferably from 1 to 8, carbon atoms (e.g., methylamino, dimethylamino, benzylamino, anilino, diphenylamino), an ammonium group (which may be substituted), for example, an ammonium group having from 0 to 15, preferably from 3 to 10, more preferably from 3 to 6, carbon atoms (e.g., trimethylammonium, triethylammonium), a hydrazino group (which may be substituted), for example, a hydrazino group having from 0 to 15, preferably from 1 to 10, more preferably from 1 to 6, carbon atoms (e.g., trimethylhydrazino), a ureido group (which may be substituted), for example, a ureido group having from 1 to 15, preferably from 1 to 10, more preferably from 1 to 6, carbon atoms (e.g., ureido, N,N-dimethylureido), an imido group (which may be substituted), for example, an imido group having from 1 to 15, preferably from 1 to 10, more preferably from 1 to 6, carbon atoms (e.g., succinimido), an alkyl- or arylthio group (which may be substituted), for example, an alkyl- or arylthio group having from 1 to 20, preferably from 1 to 12, more preferably from 1 to 8, carbon atoms (e.g., methylthio, ethylthio, carboxyethylthio, sulfobutylthio, phenylthio), an alkoxycarbonyl group (which may be substituted), for example, an alkoxycarbonyl group having from 2 to 20, preferably from 2 to 12, more preferably from 2 to 8, carbon atoms (e.g., methoxycarbonyl, ethoxycarbonyl, benzyloxycarbonyl), an aryloxycarbonyl group (which may be substituted), for example, an aryloxycarbonyl group having from 6 to 20, preferably from 6 to 12, more preferably from 6 to 8, carbon atoms (e.g., phenoxycarbonyl), an alkyl group (which may be substituted), for example, an unsubstituted alkyl group having from 1 to 18, preferably from 1 to 10, more preferably from 1 to 5, carbon atoms (e.g., methyl, ethyl, propyl, butyl), a substituted alkyl group having from 1 to 18, preferably from 1 to 10, more preferably from 1 to 5, carbon atoms (e.g., hydroxymethyl, trifluoromethyl, benzyl, carboxyethyl, ethoxycarbonylmethyl, acetylaminomethyl, in addition, an unsaturated hydrocarbon group preferably having from 2 to 18, more preferably from 3 to 10, particularly preferably from 3 to 5, carbon atoms (e.g., vinyl, ethynyl, 1-cyclohexenyl, benzylidyne, benzylidene) is also included in a substituted alkyl group), an aryl group (which may be substituted), for example, a substituted or unsubstituted aryl group having from 6 to 20, preferably from 6 to 15, more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), and a heterocyclic group (which may be substituted), for example, a heterocyclic group having from 1 to 20, preferably from 2 to 10, more preferably from 4 to 6, carbon atoms (e.g., pyridyl, 5-methylpyridyl, thienyl, furyl, morpholino, tetrahydrofurfuryl). The heterocyclic group may have the condensed structure of a benzene ring, a naphthalene ring and an anthracene ring.

These substituents may further be substituted with V.

Preferred substituents on $Z_1$ are an alkyl group, an aryl group, an alkoxyl group, a halogen atom, an acyl group, a cyano group, a sulfonyl group, or a benzene condensed ring, more preferably an alkyl group, an aryl group, a halogen atom, an acyl group, a sulfonyl group, or a benzene condensed ring, particularly preferably a methyl group, a phenyl group, a methoxy group, a chlorine atom, a bromine atom, an iodine atom or a benzene condensed ring, and most preferably a phenyl group, a chlorine atom, a bromine atom, an iodine atom or a benzene condensed ring.

The methine group represented by $L_1$ and $L_2$ each may have a substituent, the above substituents as V can be cited as examples of substituents for $L_1$ and $L_2$, and preferably an unsubstituted methine group.

$P_1$ is 0 or 1 and preferably 0.

Q represents a methine group or a polymethine group necessary to form a methine dye. The number of methine in a polymethine group is preferably from 0 to 7, more preferably from 1 to 5, and particularly preferably from 1 to 3. (When a methine group is incorporated into a heterocyclic ring, there is a case where a methine group becomes apparently zero, e.g., simple merocyanine (zero methine merocyanine) can be cited.)

A methine group or a polymethine group represented by Q may be any group as long as it forms a methine dye, but is preferably a substituted methine or polymethine group necessary to form a methine dye. Examples of substituents thereof include an aromatic group, a heterocyclic group, an amino group, a cyano group, an alkoxycarbonyl group, an alkylsulfonyl group, and an acyl group. Specifically, as an aromatic group, a substituted or unsubstituted aromatic group (e.g., 4-dimethylaminophenyl, 4-methoxyphenyl, phenyl, 4-dimethylaminonaphthyl), as a heterocyclic ring of a heterocyclic group, a basic nucleus and an acidic nucleus which are known when a dye is formed, e.g., heterocyclic rings represented by $Z_2$ to $Z_8$ described later, as an amino group, a substituted or unsubstituted amino group (e.g., amino, dimethylamino), as alkoxycarbonyl group, a substituted or unsubstituted alkoxycarbonyl group (e.g., ethoxycarbonyl), as an alkylsulfonyl group, a substituted or unsubstituted alkylsulfonyl group (e.g., methanesulfonyl), and as an acyl group, a substituted or unsubstituted acyl group (e.g., acetyl) can be cited.

Any methine dye can be formed by Q, but preferred are a cyanine dye, a merocyanine dye, a rhodacyanine dye, a trinuclear merocyanine dye, a holopolar dye, a hemicyanine dye, and a styryl dye. These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515, etc.

Formulae (XI), (XII) and (XIII) disclosed in U.S. Pat. No. 5,340,694, pp. 21 and 22 are preferred as formulae of the cyanine, merocyanine and rhodacyanine dyes, respectively.

Further, when a cyanine dye is formed by Q in formula (I), it can be represented by the following resonance formula:

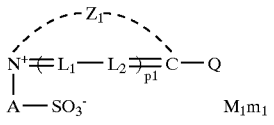

$M_1$ is included in the formula to show the presence of a cation or an anion when a counter ion is necessary for neutralizing an ionic charge of the dye. Examples of cations include an inorganic cation such as a hydrogen ion ($H^+$), an alkali metal ion (e.g., a sodium ion, a potassium ion, a lithium ion), and an alkaline earth metal ion (e.g., a calcium ion), and an organic ion such as an ammonium ion (e.g., an ammonium ion, a tetraalkylammonium ion, a pyridinium ion, an ethylpyridinium ion). Anions may be either inorganic or organic, and examples include a halogen anion (e.g., a fluorine ion, a chlorine ion, an iodine ion), a substituted arylsulfonate ion (e.g., a p-toluenesulfonate ion, a p-chlorobenzenesulfonate ion), an aryldisulfonate ion (e.g., a 1,3-benzenedisulfonate ion, a 1,5-naphthalenedisulfonate ion, a 2,6-naphthalenedisulfonate ion), an alkylsulfate ion (e.g., a methylsulfate ion), a sulfate ion, a thiocyanate ion, a perchlorate ion, a tetrafluoroborate ion, a picrate ion, an acetate ion, and a trifluoromethanesulfonate ion. In addition, ionic polymers or other dyes having a counter charge to the dye may be used.

In the present invention, a sulfo group is inscribed as $SO_3^-$ in formula (I), but it can be inscribed as $SO_3H$ when a hydrogen ion is present as a counter ion.

$m_1$ represents a number necessary for balancing a charge in the molecule and it represents 0 when an inner salt is formed.

In formula (I), A can be any group so long as it is a divalent linking group having at least one atom other than a carbon atom, but is preferably a linking group as shown below.

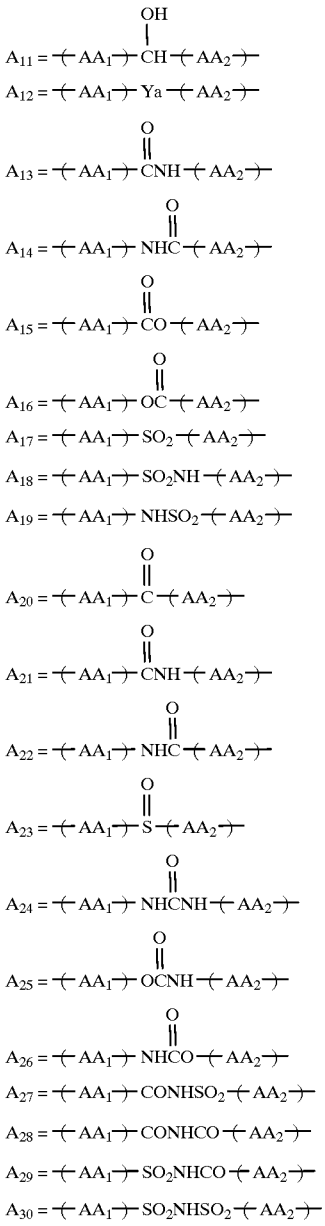

In the above formulae, $AA_1$ and $AA_2$ each represents a divalent linking group, which comprises an atom or an atomic group preferably containing at least one of a carbon atom, a nitrogen atom, a sulfur atom and an oxygen atom. $AA_1$ and $AA_2$ each preferably represents a divalent linking group having from 1 to 20 carbon atoms which is constituted in combination of one or more of an alkylene group (e.g., methylene, ethylene, propylene, butylene, pentylene), an arylene group (e.g., phenylene, naphthylene), an alkenylene group (e.g., ethenylene, propenylene), an alkynylene group (e.g., ethynylene, propynylene), an amido group, an ester group, a sulfonamido group, a sulfonate group, a ureido group, a sulfonyl group, a sulfinyl group, a thioether group, an ether group, a carbonyl group, —N(Ra)— (where Ra represents a hydrogen atom, a substituted or unsubstituted alkyl group, a substituted or unsubstituted aryl group), and a heterocyclic divalent group (e.g., 6-chloro-1,3,5-triazine-2,4-diyl, pyrimidine-2,4-diyl, quinoxaline-2,3-diyl). These divalent linking groups may further be substituted and the above-described V can be cited as substituents thereof.

$AA_1$ and $AA_2$ each more preferably represents a divalent linking group having from 1 to 10 carbon atoms which is constituted in combination of one or more of an alkylene group having from 1 to 4 carbon atoms (e.g., methylene, ethylene, propylene, butylene), an arylene group having from 6 to 10 carbon atoms (e.g., phenylene, naphthylene), an alkenylene group having from 1 to 4 carbon atoms (e.g., ethenylene, propenylene), and an alkynylene group having from 1 to 4 carbon atoms (e.g., ethynylene, propynylene).

Ya represents an oxygen atom, a sulfur atom, a nitrogen atom (which may be substituted), or a selenium atom, preferably an oxygen atom or a sulfur atom, and more preferably an oxygen atom.

Of $A_{11}$ to $A_{30}$, $A_{11}$ and $A_{12}$ are preferred.

The above $A_1$ is preferred as $A_{11}$ and $A_2$ is preferred as $A_{12}$. Particularly preferred is $A_1$.

La, Lb, Lc and Ld each represents a methylene group (in the present invention, "a methylene group" is used in the sense that a methylene group which may be substituted is also included), and the methylene group is an unsubstituted methylene group or a substituted methylene group (e.g., a methylene group substituted with the above-described V, specifically, a methylene group substituted with a methyl group, a methylene group substituted with an ethyl group, a methylene group substituted with a phenyl group, a methylene group substituted with a hydroxyl group, a methylene group substituted with a halogen atom (e.g., a chlorine atom, a bromine atom) can be cited), and La, Lb, Lc and Ld each preferably represents an unsubstituted methylene group.

$k_1$ is preferably 1, 2, 3 or 4, more preferably 1 or 2, and particularly preferably 1. $k_2$ is preferably 1, 2, 3 or 4, more preferably 1 or 2, and particularly preferably 1. $k_3$ is preferably 1, 2, 3 or 4, more preferably 2 or 3, and particularly preferably 2. $k_4$ is preferably 1, 2, 3 or 4, more preferably 2, 3 or 4, and particularly preferably 2 or 3.

Y preferably represents an oxygen atom.

Further, it is more preferred that the logP value of $—A—SO_3^-$ in formula (I) is hydrophilic as shown in JP-A-5-313290, pp. 4 and 5 (the term "JP-A" as used herein means an "unexamined published Japanese patent application"), because the residual color after processing is less.

Moreover, the compound represented by formula (I) is more preferably selected from the compounds represented by following formulae (II), (III) and (IV):

(II)

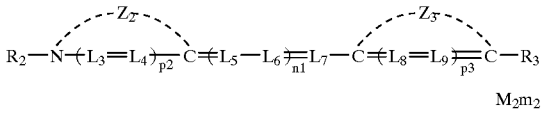

wherein $L_3$, $L_4$, $L_5$, $L_6$, $L_7$, $L_8$ and $L_9$ each represents a methine group; $p_2$ and $p_3$ each represents 0 or 1; $n_1$ represents 0, 1, 2 or 3; $Z_2$ and $Z_3$ each represents an atomic group necessary for forming a 5- or 6-membered nitrogen-containing heterocyclic ring; $M_2$ represents a counter ion for balancing a charge; $m_2$ represents a number of from 0 to 4 necessary for neutralizing a charge in the molecule; $R_2$ and $R_3$ each represents an alkyl group, provided that at least one of $R_2$ and $R_3$ is an alkyl group represented by the following $R_1$, e.g., when $R_2$ is $R_1$, $Z_2$ is $Z_1$ and when both $R_2$ and $R_3$ are $R_1$, both $Z_2$ and $Z_3$ are $Z_1$.

$$R_1 = —A—SO_3^-$$

wherein A has the same meaning as in formula (I).

(III)

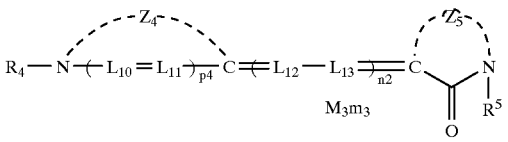

wherein $L_{10}$, $L_{11}$, $L_{12}$ and $L_{13}$ each represents a methine group; $p_4$ represents 0 or 1; $n_2$ represents 0, 1, 2 or 3; $Z_4$ and $Z_5$ each represents an atomic group necessary for forming a 5- or 6-membered nitrogen-containing heterocyclic ring; $M_3$ represents a counter ion for balancing a charge; $m_3$ represents a number of from 0 to 4 necessary for neutralizing a charge in the molecule; $R_4$ has the same meaning as $R_1$; $Z_4$ has the same meaning as $Z_2$; and $R_5$ represents an alkyl group, an aryl group or a heterocyclic group.

(IV)

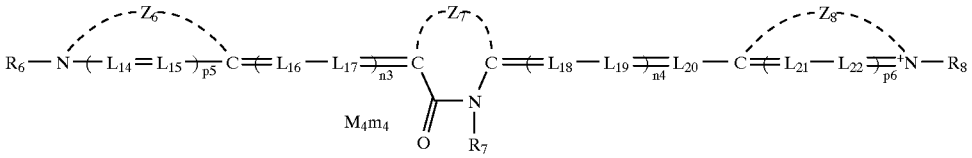

wherein $L_{14}$, $L_{15}$, $L_{16}$, $L_{17}$, $L_{18}$, $L_{19}$, $L_{20}$, $L_{21}$ and $L_{22}$ each represents a methine group; $p_5$ and $p_6$ each represents 0 or 1; $n_3$ and $n_4$ each represents 0, 1, 2 or 3; $Z_6$, $Z_7$ and $Z_8$ each represents an atomic group necessary for forming a 5- or 6-membered nitrogen-containing heterocyclic ring; $M_4$ represents a counter ion for balancing a charge; $m_4$ represents a number of from 0 to 4 necessary for neutralizing a charge in the molecule; $R_6$ and $R_8$ each represents an alkyl group; $R_7$ represents an alkyl group, an aryl group or a heterocyclic group, provided that at least one of $R_6$ and $R_8$ represents $R_1$, e.g., when $R_6$ is $R_1$, $Z_6$ is $Z_1$ and when $R_8$ is $R_1$, $Z_8$ is $Z_1$.

Of formulae (II), (III) and (IV), formula (II) is preferred.

$Z_2$, $Z_3$, $Z_4$, $Z_6$ and $Z_8$ in formulae (II), (III) and (IV) each has the same meaning as $Z_1$ and the similar ones are preferred.

$R_2$, $R_3$, $R_4$, $R_6$ and $R_8$ each represents an alkyl group, e.g., an unsubstituted alkyl group having from 1 to 18, preferably from 1 to 7, particularly preferably from 1 to 4, carbon atoms (e.g., methyl, ethyl, propyl, isopropyl, butyl, isobutyl, hexyl, octyl, dodecyl, octadecyl), or a substituted alkyl group having from 1 to 18, preferably from 1 to 7, particularly preferably from 1 to 4, carbon atoms (e.g., a heterocyclic group substituted with V, which is described above as a substituent of $Z_1$, can be cited, preferably an aralkyl group (e.g., benzyl, 2-phenylethyl), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl, $R_1$ of the present invention), a sulfoalkenyl group (e.g., sulfopropenyl), a sulfatoalkyl group (e.g., 2-sulfatoethyl, 3-sulfatopropyl, 4-sulfatobutyl), a heterocyclic group-substituted alkyl group (e.g., 2-(pyrrolidin-2-one-1-yl)ethyl, tetrahydrofurfuryl), or an alkylsulfonylcarbamoylmethyl group (e.g., methanesulfonylcarbamoylmethyl)).

Preferred alkyl groups for $R_2$, $R_3$, $R_4$, $R_6$ and $R_8$ are the above-described carboxyalkyl group, sulfoalkyl group, sulfoalkenyl group, unsubstituted alkyl group and $R_1$ of the present invention, and more preferred are the sulfoalkyl group and $R_1$ of the present invention.

$Z_5$ represents an atomic group necessary for forming an acidic nucleus and any form of an acidic nucleus of general merocyanine dyes can be used. An acidic nucleus used in the present invention is defined, for example, by James, *The Theory of the Photographic Process*, 4th Ed., p. 198, Macmillan (1977). Specifically, those disclosed in U.S. Pat. Nos. 3,567,719, 3,575,869, 3,804,634, 3,837,862, 4,002,480, 4,925,777 and JP-A-3-167546 can be cited.

When a 5- or 6-membered nitrogen-containing heterocyclic ring comprising carbon, nitrogen and chalcogen (typically, oxygen, sulfur, selenium, tellurium) atoms is formed by an acidic nucleus, the following nuclei are cited as preferred examples: 2-pyrazolin-5-one, pyrazolidine-3,5-dione, imidazolin-5-one, hydantoin, 2- or 4-thiohydantoin, 2-iminooxazolidin-4-one, 2-oxazolin-5-one, 2-thiooxazoline-2,4-dione, isooxazolin-5-one, 2-thiazolin-4-one, thiazolidin-4-one, thiazolidine-2,4-dione, rhodanine, thiazolidine-2,4-dithione, isorhodanine, indane-1,3-dione, thiophen-3-one, thiophen-3-one-1,1-dioxide, indolin-2-one, indolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinolin-4-one, 1,3-dioxane-4,6-dione, barbituric acid, 2-thiobarbituric acid, chroman-2,4-dione, indazolin-2-one, pyrido[1,2-a]pyrimidine-1,3-dione, pyrazolo[1,5-b]quinazolone, pyrazolo[1,5-a]benzimidazole, pyrazolopyridone, 1,2,3,4-tetrahydroquinoline-2,4-dione, 3-oxo-2,3-dihydrobenzo[d]thiophene-1,1-dioxide, and 3-dicyanomethine-2,3-dihydrobenzo[d]thiophene-1,1-dioxide.

Preferred as $Z_5$ are hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, and 2-thiobarbituric acid, more preferred are hydantoin, 2- or 4-thiohydantoin, 2-oxazolin-5-one, rhodanine, barbituric acid, and 2-thiobarbituric acid, and particularly preferred are 2- or 4-thiohydantoin, 2-oxazolin-5-one and rhodanine.

The 5- or 6-membered nitrogen-containing heterocyclic ring formed by $Z_7$ is a heterocyclic ring obtained by eliminating an oxo group or a thioxo group from the heterocyclic ring formed by $Z_5$, preferably eliminating an oxo group or a thioxo group from hydantoin, 2- or 4-thiohydantoin, 2-oxazolin-5-one, 2-thiooxazoline-2,4-dione, thiazolidine-2,4-dione, rhodanine, thiazolidine-2,4-dithione, barbituric acid, or 2-thiobarbituric acid, more preferably eliminating an oxo group or a thioxo group from hydantoin, 2- or 4-thiohydantoin, 2-oxazolin-5-one, rhodanine, barbituric acid, or 2-thiobarbituric acid, and particularly preferably eliminating an oxo group or a thioxo group from 2- or 4-thiohydantoin, 2-oxazolin-5-one, or rhodanine.

As alkyl groups represented by $R_5$ and $R_7$, unsubstituted alkyl groups, substituted alkyl groups or $R_1$ as described above as examples of the substituents of $R_2$, etc., can be cited and the similar ones are preferred. Further, an unsubstituted aryl group having from 6 to 20, preferably from 6 to 10, more preferably from 6 to 8, carbon atoms (e.g., phenyl, 1-naphthyl), a substituted aryl group having from 6 to 20, preferably from 6 to 10, more preferably from 6 to 8, carbon atoms (e.g., aryl groups substituted with V described as the substituent of $Z_1$, specifically p-methoxyphenyl, p-methylphenyl, p-chlorophenyl), an unsubstituted heterocyclic group having from 1 to 20, preferably from 3 to 10, more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, more preferably from 4 to 8, carbon atoms (e.g., heterocyclic groups substituted with V described as the substituent of $Z_1$, specifically 5-methyl-2-thienyl, 4-methoxy-2-pyridyl) can be cited.

Preferred groups as $R_5$ and $R_7$ are methyl, ethyl, 2-sulfoethyl, 3-sulfopropyl, 3-sulfobutyl, 4-sulfobutyl, carboxymethyl, phenyl, 2-pyridyl, and 2-thiazolyl, more preferred are ethyl, 2-sulfoethyl, carboxymethyl, phenyl, and 2-pyridyl.

$L_3$, $L_4$, $L_5$, $L_6$, $L_7$, $L_8$, $L_9$, $L_{10}$, $L_{11}$, $L_{12}$, $L_{13}$, $L_{14}$, $L_{15}$, $L_{16}$, $L_{17}$, $L_{18}$, $L_{19}$, $L_{20}$, $L_{21}$ and $L_{22}$ each independently represents a methine group. Each of the methine groups represented $L_3$ to $L_{22}$ may have a substituent and examples of such substituents include a substituted or unsubstituted alkyl group having from 1 to 15, preferably from 1 to 10, more preferably from 1 to 5, carbon atoms (e.g., methyl, ethyl, 2-carboxyethyl), a substituted or unsubstituted aryl group having from 6 to 20, preferably from 6 to 15, more preferably from 6 to 10, carbon atoms (e.g., phenyl, o-carboxyphenyl), a substituted or unsubstituted heterocyclic group having from 3 to 20, preferably from 4 to 15, more preferably from 6 to 10, carbon atoms (e.g., N,N-diethylbarbituric acid), a halogen atom (e.g., chlorine, bromine, fluorine, iodine), an alkoxyl group having from 1 to 15, preferably from 1 to 10, more preferably from 1 to 5, carbon atoms (e.g., methoxy, ethoxy), an alkylthio group having from 1 to 15, preferably from 1 to 10, more preferably from 1 to 5, carbon atoms (e.g., methylthio, ethylthio), an arylthio group having from 6 to 20, preferably from 6 to 15, more preferably from 6 to 10, carbon atoms (e.g., phenylthio), and an amino group having from 0 to 15, preferably from 2 to 10, more preferably from 4 to 10, carbon atoms (e.g., N,N-diphenylamino, N-methyl-N-phenylamino, N-methylpiperazino). Each of $L_3$ to $L_{22}$ may form a ring together with other methine group or can form a ring together with $Z_2$, $Z_3$, $Z_4$, $Z_6$ or $Z_8$.

$n_1$, $n_2$ and $n_3$ are each preferably 0, 1 or 2, more preferably 0 or 1, and particularly preferably 1. $n_4$ is preferably 0 or 1 and more preferably 1. When $n_1$, $n_2$, $n_3$ and $n_4$ each represents 2 or more, a methine group is repeated but they are not necessary to be the same group.

$M_2$, $M_3$ and $M_4$, and $m_2$, $m_3$ and $m_4$ each has the same meaning as $M_1$ and $m_1$ in formula (III) and the similar ones are preferred.

$p_2$, $p_3$, $p_4$, $p_5$ and $p_6$ each independently represents 0 or 1, and preferably 0.

Specific examples of the compounds represented by formula (I) (including (II), (III) and (IV) of the subordinate concept), but the present invention is not limited thereto.

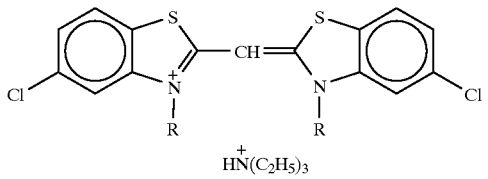

(1)

R = $-CH_2CH(OH)CH_2SO_3^-$;

(2)

R = $-(CH_2)_2O(CH_2)_3SO_3^-$;

(3)

R = $-(CH_2)_2S-(CH_2)_4SO_3^-$;

(4)

R = $-CH_2CONH(CH_2)_3SO_3^-$;

(5)

R = $-CH_2NHC(=O)NH(CH_2)_2SO_3^-$;

(6)

R = $-(CH_2)_2-N(CH_3)-(CH_2)_3SO_3^-$;

(7)

R = $-CH_2CO_2-(CH_2)_3SO_3^-$;

(8)

R = $-CH_2CONHSO_2-(CH_2)_3SO_3^-$;

(9)

R = $-CH_2C(=O)(CH_2)_2SO_3^-$;

(10)

R = $-(CH_2)_2S(=O)-(CH_2)_3SO_3^-$;

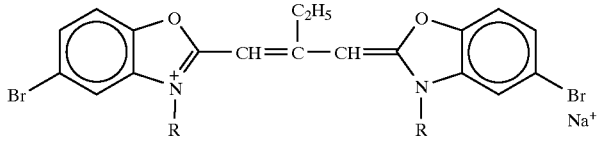

(11)

R = $CH_2CH(OH)CH_2SO_3^-$;

(12)

R = $(CH_2)_2O-(CH_2)_3SO_3^-$;

-continued
(13)
$R = (CH_2)_2C(=O)-(CH_2)_3SO_3^-$;
(14)
$R = (CH_2)_3S-(CH_2)_2SO_3^-$;
(15)
$R = -(CH_2)_2CONH(CH_2)_3SO_3^-$;
(16)
$R = -(CH_2)_2SO_2NH(CH_2)_2SO_3^-$;
(17)
$R = -(CH_2)_2C(=O)O(CH_2)_2SO_3^-$;
(18)
$R = -(CH_2)_2CH(OH)-(CH_2)_3SO_3^-$;
(19)
$R = -(CH_2)_2CH(OH)-(CH_2)_4SO_3^-$;
(20)
$R = -(CH_2)_2OC(=O)-(CH_2)_2SO_3^-$;
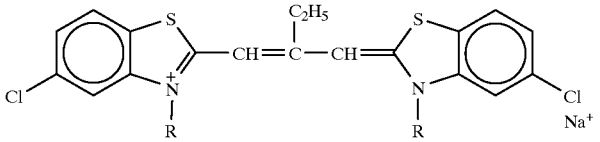
(21)
$R = CH_2CH(OH)CH_2SO_3^-$;
(22)
$R = (CH_2)_2O-(CH_2)_3SO_3^-$;
(23)
$R = (CH_2)_2C(=O)-(CH_2)_3SO_3^-$;
(24)
$R = (CH_2)_3S-(CH_2)_2SO_3^-$;
(25)
$R = -(CH_2)_2CONH(CH_2)_3SO_3^-$;
(26)
$R = -(CH_2)_2SO_2NH(CH_2)_2SO_3^-$;
(27)
$R = -(CH_2)_2C(=O)O(CH_2)_2SO_3^-$;
(28)
$R = -(CH_2)_2CH(OH)-(CH_2)_3SO_3^-$;
(29)
$R = -(CH_2)_2CH(OH)-(CH_2)_4SO_3^-$;
(30)
$R = -(CH_2)_2OC(=O)-(CH_2)_2SO_3^-$;

-continued
(31)
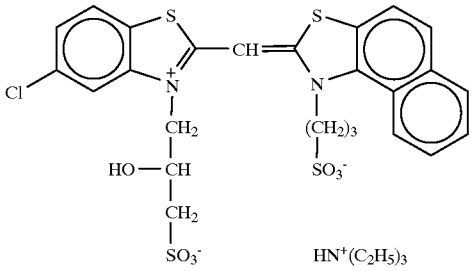
(32)
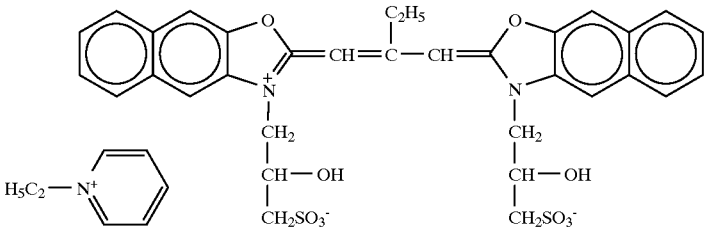
(33)
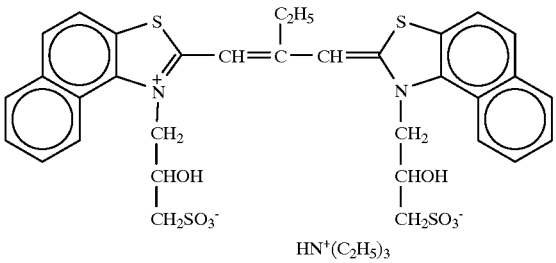
(34)
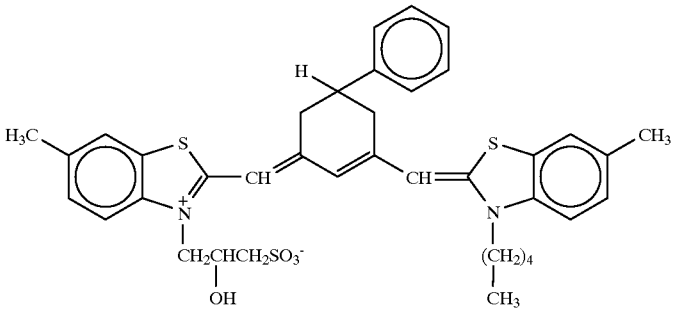
(35)
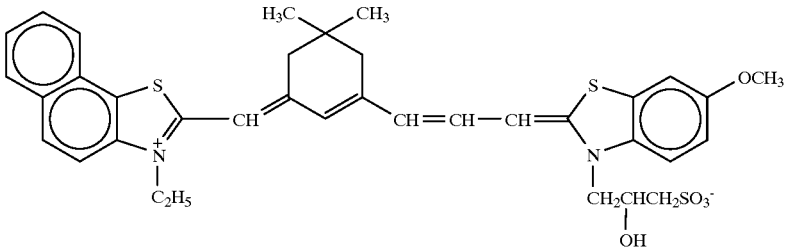

-continued (36)

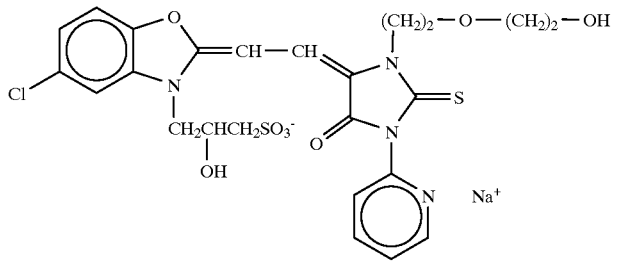

(37)

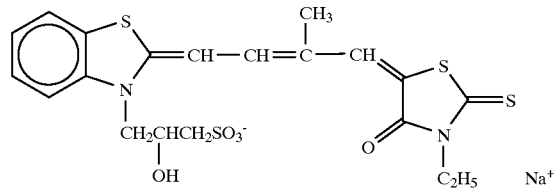

(38)

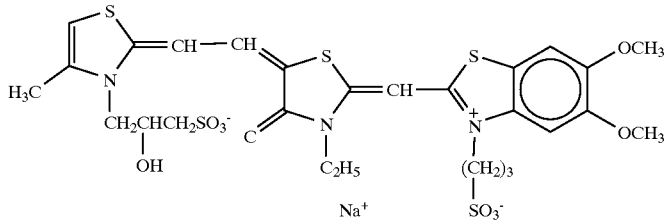

(39)

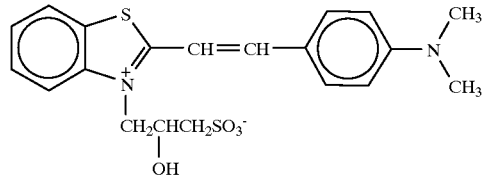

The compound represented by formula (I) (including (II), (III) and (IV) of the subordinate concept) according to the present invention can be synthesized according to the methods described in F. M. Harmer, *Heterocyclic Compounds—Cyanine Dyes and Related Compounds*, John Wiley & Sons, New York, London (1964), D. M. Sturmer, *Heterocyclic Compounds— Special Topics in Heterocyclic Chemistry*, Chap. 18, Clause 14, pp. 482 to 515, John Wiley & Sons, New York, London (1977), *Rodd's Chemistry of Carbon Compounds*, 2nd Ed., Vol. IV, Part B, Chap. 15, pp. 369 to 422, Elsevier Science Publishing Company Inc., New York (1977) and the like.

The spectral sensitizing dye represented by formula (I) is added preferably in an amount of from $0.5\times10^{-6}$ mol to $1.0\times10^{-2}$ mol, and more preferably from $1.0\times10^{-5}$ mol to $5.0\times10^{-3}$ mol, per mol of the silver halide. This spectral sensitizing dye is preferably used for a reduction sensitized emulsion.

A sensitizing dye may be added during silver halide grain formation stage or during chemical sensitization stage, or may be added at the time of coating.

Methods of the addition of a sensitizing dye during silver halide grain formation stage disclosed in U.S. Pat. Nos. 4,225,666, 4,828,972 and JP-A-61-103149 can be referred to. Methods of the addition of a sensitizing dye during desalting stage disclosed in EP-A-291339 and JP-A-64-52137 can be referred to. Further, methods of the addition of a sensitizing dye during chemical sensitization stage disclosed in JP-A-59-48756 can be referred to.

As a method for increasing spectral sensitization sensitivity using a sensitizing dye, methods of using sensitizing dyes in combination of two or more are known. When two or more sensitizing dyes are used in combination, in many cases, the spectral sensitivity obtained becomes medium of the effect of the time when each dye is used alone, or lowers, but if sensitizing dyes are used in a specific combination, in some cases, spectral sensitivity markedly increases compared with the time when each sensitizing dye is used alone. This phenomenon is, in general, called a supersensitization effect of sensitizing dyes. Supersensitization effect is disclosed collectively in T. H. James (in collaboration with W. West and P. B. Gilman), *The Theory of the Photographic Process*, 4th Ed., Chap. 10, Macmillan, New York (1977).

When such combinations of dyes are used, the spectral sensitivity wavelength sometimes becomes medium of the spectral sensitivity wavelength of the time when each dye is used alone, or becomes a mere connection, but in some cases spectral sensitization shifts to the wavelength which cannot be forecast from the spectral characteristic by a single use.

It has been an important problem to be solved in the technique of spectral sensitivity of a silver halide photographic emulsion to obtain higher spectral sensitivity by a combined use of sensitizing dyes than that which can be obtained when each sensitizing dye is used alone and to find out a combination of sensitizing dyes having a sensitization wavelength range suitable for the use purpose of a photographic material.

Each dye to be used in combination for obtaining supersensitization should be strictly selected as a minute difference in chemical structures strikingly affects supersensitization effect. That is, a combination of sensitizing dyes which brings about supersensitization effect is difficult to be forecast only from their chemical structural formulae.

As a supersensitizer, dyes which themselves do not have a spectral sensitizing function or substances which substantially do not absorb visible light can also be used. For example, aminostyryl compounds substituted with a nitrogen-containing heterocyclic group (e.g., those disclosed in U.S. Pat. Nos. 2,933,390 and 3,635,721), condensation products of aromatic organic acid and formaldehyde (e.g., those disclosed in U.S. Pat. No. 3,743,510), a cadmium salt or an azaindene compound can be contained. Combinations disclosed in U.S. Pat. Nos. 3,615,613, 3,615,641, 3,617,295 and 3,635,721 are particularly useful.

The production process of a silver halide emulsion can be classified broadly into processes of grain formation, desalting and chemical sensitization. The grain formation is divided into nucleation, ripening, growing and the like. These processes are not conducted evenly but the order is reversed in some case and one process is conducted repeatedly in another case. Reduction sensitization of silver halide emulsion can be conducted fundamentally at any stage of the production process of a silver halide emulsion, that is, it may be conducted at nucleation stage which is the early stage of the grain formation, at the stage of physical ripening or grain growth, or prior to chemical sensitization other than reduction sensitization or after this chemical sensitization. When chemical sensitization is conducted in combination with gold sensitization, reduction sensitization is preferably conducted prior to chemical sensitization so as not to generate unwanted fog. The most preferred method is to conduct reduction sensitization during growth of silver halide grains. Herein, "during growth of grains" means to include the method of conducting reduction sensitization in the state when silver halide grains are growing by physical ripening or by the addition of water-soluble silver salt and water-soluble alkali halide, or the method of further growing grains after reduction sensitization is conducted in the state when the growth is stopped temporarily.

As the method of the reduction sensitization for use in the present invention, a method in which known reducing agents are added to a silver halide emulsion, a method in which grains are grown or ripened in the atmosphere of low pAg of from 1 to 7 which is called silver ripening, and a method in which grains are grown or ripened in the atmosphere of high pH of from 8 to 11 which is called high pH ripening are known. Two or more of these methods can be used in combination.

A method of adding a reduction sensitizer is preferred from the point of capable of delicately controlling the level of the reduction sensitization.

Stannous salt, amines and polyamines, hydrazine derivatives, formamidinesulfinic acid, silane compounds and borane compounds are well known as a reduction sensitizer. These known compounds can be selected and used in the present invention, and two or more of these compounds can also be used in combination. Stannous chloride, thiourea dioxide, and dimethylamineborane (alkynylamine compounds disclosed in U.S. Pat. No. 5,389,510) are preferred compounds as a reduction sensitizer. A more preferred compound is thiourea dioxide. As the addition amount of a reduction sensitizer depends upon the production conditions of the emulsion, the addition amount needs to be selected, but $10^{-7}$ to $10^{-3}$ mol per mol of the silver halide is preferred.

Ascorbic acid and derivatives thereof can also be used as a reduction sensitizer according to the present invention.

The following compounds can be cited as specific examples of ascorbic acids and derivatives thereof (hereinafter referred to as "ascorbic acid compounds").

(A-1) L-Ascorbic acid
(A-2) Sodium L-ascorbate
(A-3) Potassium L-ascorbate
(A-4) DL-Ascorbic acid
(A-5) Sodium D-ascorbate
(A-6) L-Ascorbic acid-6-acetate
(A-7) L-Ascorbic acid-6-palmitate
(A-8) L-Ascorbic acid-6-benzoate
(A-9) L-Ascorbic acid-5,6-diacetate
(A-10) L-Ascorbic acid-5,6-o-isopropylidene It is preferred that the ascorbic acid compounds for use in the present invention are used in larger amount compared with the addition amount of reduction sensitizers which is the amount conventionally preferably used. For example, there are disclosed in JP-B-57-33572 that "The amount of a reducing agent, in general, does not exceed $0.75\times10^{-2}$ milli-equivalent ($8\times10^{-4}$ mol/AgX mol) per gram of the silver ion. The amount of from 0.1 to 10 mg (as ascorbic acid, from $10^{-7}$ to $10^{-5}$ mol/AgX mol) per kg of the silver nitrate is in many cases effective." (calculated values are by the present inventors), in U.S. Pat. No. 2,487,850, "the addition amount of a tin compound which can be used as a reduction sensitizer is from $1\times10^{-7}$ to $44\times10^{-6}$ mol", and in JP-A-57-179835, "the appropriate addition amount of thiourea dioxide is from about 0.01 mg to about 2 mg per mol of the silver halide, and that of a stannous chloride is from about 0.01 mg to about 3 mg per mol of the silver halide". Although the preferred addition amount of the ascorbic acid compounds for use in the present invention depends upon the grain size of the emulsion, the halogen composition, the temperature, pH and pAg of the production of the emulsion, it is preferred to select the amount from the range of from $5\times10^{-5}$ to $1\times10^{-1}$ mol, more preferably from $5\times10^{-4}$ to $1\times10^{-2}$ mol, and particularly preferably from $1\times10^{-3}$ to $1\times10^{-2}$ mol, per mol of the silver halide. Of reduction sensitizers, thiourea dioxide is particularly preferred.

Reduction sensitizers can be dissolved in water or a solvent such as alcohols, glycols, ketones, esters or amides and added during grain formation, before or after chemical sensitization. They may be added at any stage of the emulsion production process, but a method of adding them during grain growth is particularly preferred. They may be previously added to a reaction vessel but more preferably they are added at a proper stage during grain growth. Further, reduction sensitizers have been previously added to an aqueous solution of water-soluble silver salt or an aqueous solution of water-soluble alkali halide and grains can be grown using these aqueous solutions. In addition, the solution of reduction sensitizers may be divided to several parts and added in several times or may be added continuously over a long period of time with the degree of the grain growth.

It is preferred to use an oxidizing agent for silver during the production process of the emulsion of the present invention. An oxidizing agent for silver is a compound having a function of acting on metal silver and converting it to a silver ion. In particular, a compound which can convert superminute silver grains by-produced in the course of the formation of silver halide grains and chemical sensitization to a silver ion is effective. The silver ion converted may form hardly water-soluble silver salt such as silver halide, silver sulfide or silver selenide, or may form easily water-soluble silver salt such as silver nitrate. An oxidizing agent for silver may be inorganic or organic. Examples of inorganic oxidizing agents include ozone, oxyacid salt, such as hydrogen peroxide and addition products thereof (e.g., $NaBO_2.H_2O_2.3H_2O$, $2Na_2CO_3.3H_2O_2$, $Na_4P_2O_7.2H_2O_2$, $2Na_2SO_4.H_2O_2.2H_2O$), peroxyacid salt (e.g., $K_2S_2O_8$, $K_2C_2O_6$, $K_2P_2O_8$), a peroxy complex compound (e.g., $K_2[Ti(O_2)C_2O_4].3H_2O$, $4K_2SO_4.Ti(O_2)OH.SO_4.2H_2O$, $Na_3[VO(O_2)(C_2H_4)_2].6H_2O$), permanganate (e.g., $KMnO_4$), and chromate (e.g., $K_2Cr_2O_7$), a halogen element such as iodine and bromine, perhalogen acid salt (e.g., potassium periodate), a metal salt of high valency (e.g., potassium hexacyanoferrate-(III)), and thiosulfonate. Further, examples of organic oxidizing agents include quinones such as p-quinone, organic peroxide such as peracetic acid and perbenzoic acid, a compound which releases active halogen (e.g., N-bromosuccinimide, chloramine T, chloramine B).

Disulfide compounds disclosed in EP-A-627657 are more preferred oxidizing agents.

The oxidizing agents which are preferably used in the present invention are inorganic oxidizing agents such as ozone, hydrogen peroxide and addition products thereof, a halogen element, and thiosulfinate, and organic oxidizing agents such as quinones. It is preferred to use the above-described reduction sensitization in combination with an oxidizing agent for silver. The method of usage can be selected from a method in which an oxidizing agent is used and then reduction sensitization is carried out, an inverse method thereof, or a method in which both are concurred with. These methods can be used selectively in a grain formation process or in a chemical sensitization process.

The silver halide photographic material of the present invention preferably contains at least one compound selected from the compounds represented by the above-described formula (XX), (XXI) or (XXII).

Formulae (XX), (XXI) and (XXII) are described in detail below.

When $R_{101}$, $R_{102}$ and $R_{103}$ each represents an aliphatic group, the aliphatic group is preferably an alkyl group having from 1 to 22 carbon atoms, an alkenyl group having from 2 to 22 carbon atoms, or an alkynyl group, and these groups may be substituted. Examples of alkyl groups include, e.g., methyl, ethyl, propyl, butyl, pentyl, hexyl, octyl, 2-ethylhexyl, decyl, dodecyl, hexadecyl, octadecyl, cyclohexyl, isopropyl and t-butyl.

Examples of alkenyl groups include, e.g., allyl and butenyl.

Examples of alkynyl groups include, e.g., propargyl and butynyl.

When $R_{101}$, $R_{102}$ and $R_{103}$ each represents an aromatic group, the aromatic group is preferably an aromatic group having from 6 to 20 carbon atoms, e.g., phenyl and naphthyl. These groups may be substituted.

When $R_{101}$, $R_{102}$ and $R_{103}$ each represents a heterocyclic group, the heterocyclic group is a 3 to 15-membered ring having at least one element selected from nitrogen, oxygen, sulfur, selenium or tellurium. Examples of heterocyclic rings include, e.g., a pyrrolidine ring, a piperidine ring, a pyridine ring, a tetrahydrofuran ring, a thiophene ring, an oxazole ring, a thiazole ring, an imidazole ring, a benzothiazole ring, a benzoxazole ring, a benzimidazole ring, a selenazole ring, a benzoselenazole ring, a tetrazole ring, a triazole ring, a benzotriazole ring, a tetrazole ring, an oxadiazole ring, and a thiadiazole ring.

Examples of substituents for $R_{101}$, $R_{102}$ and $R_{103}$ include, e.g., an alkyl group (e.g., methyl, ethyl, hexyl), an alkoxyl group (e.g., methoxy, ethoxy, octyloxy), an aryl group (e.g., phenyl, naphthyl, tolyl), a hydroxyl group, a halogen atom (e.g., fluorine, chlorine, bromine, iodine), an aryloxy group (e.g., phenoxy), an alkylthio group (e.g., methylthio, butylthio), an arylthio group (e.g., phenylthio), an acyl group (e.g., acetyl, propionyl, butyryl, valeryl), a sulfonyl group (e.g., methylsulfonyl, phenylsulfonyl), an acylamino group (e.g., acetylamino, benzamino), a sulfonylamino group (e.g., methanesulfonylamino, benzenesulfonylamino), an acyloxy group (e.g., acetoxy, benzoxy), a carboxyl group, a cyano group, a sulfo group, and an amino group.

E preferably represents a divalent aliphatic group or a divalent aromatic group. Examples of divalent aliphatic groups represented by E include, e.g., $—(CH_2)_n—$ (n is from 1 to 12),

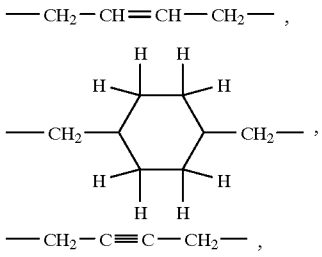

a xylylene group, etc. Examples of divalent aromatic groups represented by E include, e.g., phenylene and naphthylene.

These substituents may further be substituted with substituents such as the above-described V and the like.

$M_{101}$ preferably represents a metal ion or an organic cation. Examples of metal ions include a lithium ion, a sodium ion, and a potassium ion. Examples of organic cations include an ammonium ion (e.g., ammonium, tetramethylammonium, tetrabutylammonium), a phosphonium ion (e.g., tetraphenylphosphonium), a guanidine group, etc.

Specific examples of the compounds represented by formula (XX), (XXI) or (XXII) are shown below, but the present invention is not limited to these compounds.

(XX-1)

$CH_3SO_2SNa$ (XX-2)

$C_2H_5SO_2SNa$ (XX-3)

$C_3H_7SO_2SK$ (XX-4)

$C_4H_9SO_2SLi$ (XX-5)

$C_6H_{13}SO_2SNa$ (XX-6)

$C_8H_{17}SO_2SNa$ (XX-7)

$CH_3(CH_2)_3CH(C_2H_5)CH_2SO_2S \cdot NH_4$ (XX-8)

$C_{10}H_{21}SO_2SNa$

-continued
(XX-9)
$C_{12}H_{25}SO_2SNa$
(XX-10)
$C_{16}H_{33}SO_2SNa$
(XX-11)
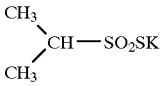
(XX-12)
$t-C_4H_9SO_2SNa$
(XX-13)
$CH_3OCH_2CH_2SO_2S \cdot Na$
(XX-14)
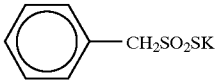
(XX-15)
$CH_2{=}CHCH_2SO_2SNa$
(XX-16)
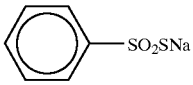
(XX-17)
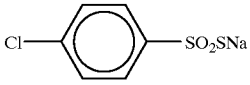
(XX-18)
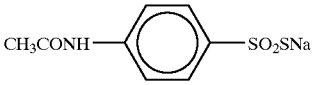
(XX-19)
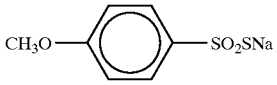
(XX-20)
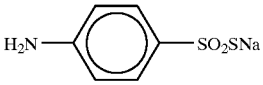
(XX-21)
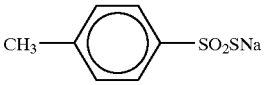
(XX-22)
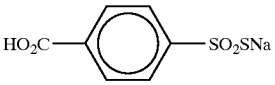
(XX-23)
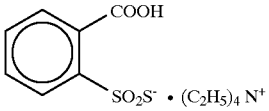
(XX-24)
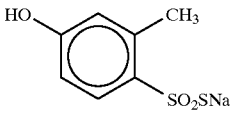
-continued
(XX-25)
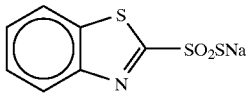
(XX-26)
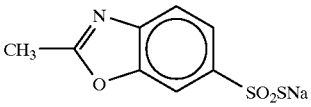
(XX-27)
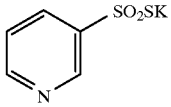
(XX-28)
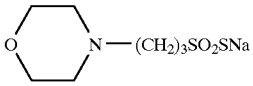
(XX-29)
$KSSO_2(CH_2)_2SO_2SK$
(XX-30)
$NaSSO_2(CH_2)_4SO_2SNa$
(XX-31)
$NaSSO_2(CH_2)_4S(CH_2)_4SO_2SNa$
(XX-32)
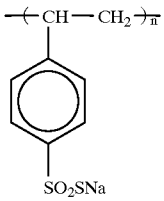
(XX-33)
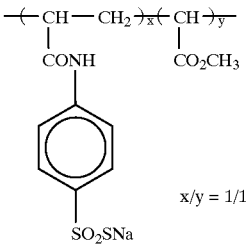
x/y = 1/1 (mol ratio)
(XXI-1)
$C_2H_5SO_2S-CH_3$
(XXI-2)
$C_8H_{17}SO_2SCH_2CH_3$
(XXI-3)
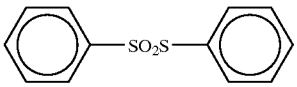
(XXI-4)
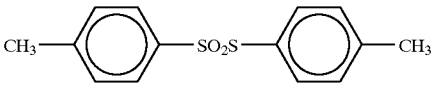
(XXI-5)
$C_2H_5SO_2SCH_2CH_2CN$ -continued
(XXI-6)
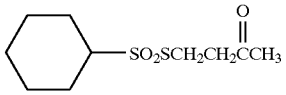
(XXI-7)
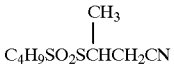
(XXI-8)
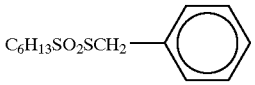
(XXI-9)
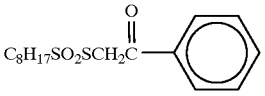
(XXI-10)
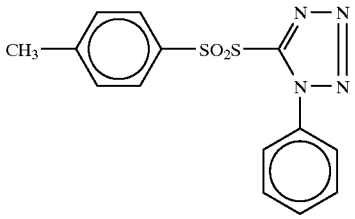
(XXI-11)
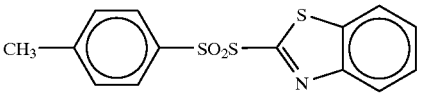
(XXI-12)
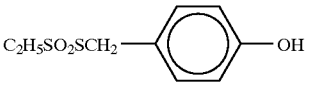
(XXI-13)
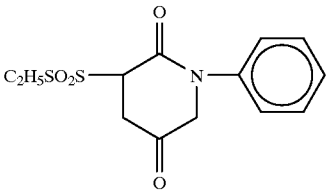
(XXI-14)
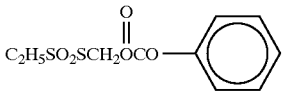
(XXI-15)
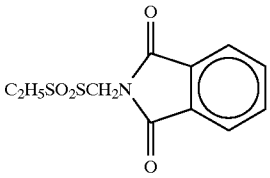
(XXI-16)
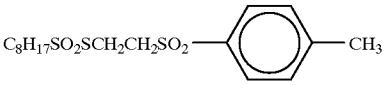
-continued
(XXI-17)
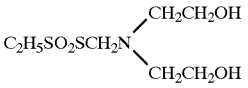
(XXI-18)
$C_2H_5SO_2SCH_2CH_2CH_2CH_2OH$
(XXI-19)
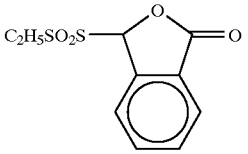
(XXI-20)
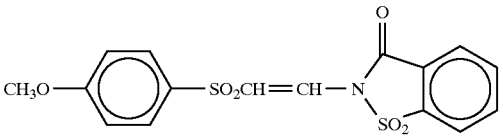
(XXI-21)
$CH_3SSO_2(CH_2)_4SO_2SCH_3$
(XXI-22)
$CH_3SSO_2(CH_2)_2SO_2SCH_3$
(XXI-23)
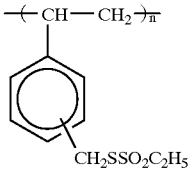
(XXI-24)
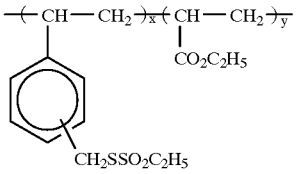
x/y = 2/1 (mol ratio)
(XXI-25)
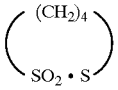
(XXII-1)
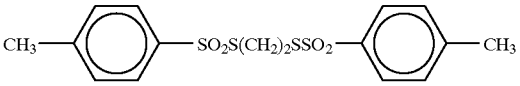
(XXII-2)
$C_2H_5SO_2SCH_2CH_2SO_2CH_2CH_2SSO_2C_2H_5$
(XXII-3)
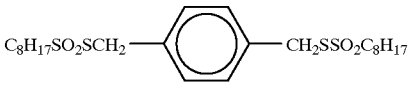
(XXII-4)
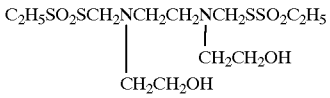

-continued (XXII-5)

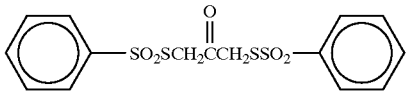

(XXII-6)

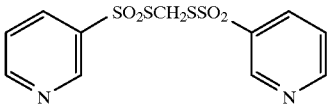

(XXII-7)

$C_2H_5SO_2SSSO_2C_2H_5$ (XXII-8)

$(n)C_3H_7SO_2SSSO_2C_3H_7(n)$ (XXII-9)

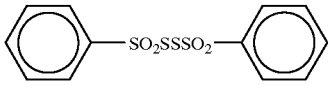

The compound represented by formula (XX) can be easily synthesized according to the methods disclosed in JP-A-54-1019 and British Patent 972,211.

The compound represented by formula (XX), (XXI) or (XXII) is preferably added in an amount of from $10^{-7}$ to $10^{-1}$ mol, more preferably from $10^{-6}$ to $10^{-2}$ mol, and particularly preferably from $10^{-5}$ to $10^{-3}$ mol, per mol of the silver halide.

For adding the compound represented by formula (XX), (XXI) or (XXII) to an emulsion during the production process thereof, methods usually used for adding additives to a photographic emulsion can be used. For example, a compound which is soluble in water is added as an aqueous solution having proper concentration, and a compound which is insoluble or hardly soluble in water is dissolved in an appropriate organic solvent which is miscible with water and does not adversely affect photographic properties selected from alcohols, glycols, ketones, esters or amides, and added as a solution.

The compound represented by formula (XX), (XXI) or (XXII) can be added to an emulsion at any stage such as during the grain formation of a silver halide emulsion, before or after chemical sensitization. The compound is preferably added before reduction sensitization is conducted or during reduction sensitization is being conducted. The compound is particularly preferably added during grain growing.

The compound may be previously added to a reaction vessel but it is more preferred to be added at an appropriate stage during grain formation. Further, the compound represented by formula (XX), (XXI) or (XXII) has been previously added to an aqueous solution of water-soluble silver salt or an aqueous solution of water-soluble alkali halide and grains can be grown using these aqueous solutions. In addition, the solution of the compound represented by formula (XX), (XXI) or (XXII) may be divided to several parts and added in several times or may be added continuously over a long period of time with the degree of the grain growth.

Of the compounds represented by formula (XX), (XXI) or (XXII), the compound represented by formula (XX) is most preferably used in the present invention.

The photographic material of the present invention is not particularly limited and can be applied to a color negative film, a color positive film, a black-and-white photographic material, negative and positive films for cinematographic use. The photographic material of the present invention can comprise at least one light-sensitive layer on a support. In a typical embodiment, the silver halide photographic material comprises at least one light-sensitive layer consisting of a plurality of silver halide emulsion layers having substantially the same spectral sensitivity but different degrees of sensitivity on a support. In a silver halide photographic material, the light-sensitive layer is a unit light-sensitive layer having a spectral sensitivity to any of blue light, green light and red light. In a multilayer silver halide color photographic material, these unit light-sensitive layers are generally arranged in the order of red-sensitive layer, green-sensitive layer and blue-sensitive layer from the support side. However, the order of the arrangement can be reversed depending on the purpose, alternatively, the light-sensitive layers may be arranged in such a way that a layer having a different spectral sensitivity is interposed between layers having the same spectral sensitivity. Light-insensitive layers may be provided between the above-described silver halide light-sensitive layers, and on the uppermost layer and beneath the lowermost layer of the silver halide light-sensitive layers. These light-insensitive layers may contain couplers, DIR compounds and color mixing preventives described below. As the plurality of silver halide emulsion layers constituting each unit light-sensitive layer, a two-layer structure of a high sensitivity emulsion layer and a low sensitivity emulsion layer can be preferably used with the emulsion layers being arranged so as to decrease in sensitivity toward a support in turn as disclosed in German Patent 1,121,470 and British Patent 923,045. In addition, a low sensitivity emulsion layer may be provided farther from the support and a high sensitivity emulsion layer may be provided nearer to the support as disclosed in JP-A-57-112751, JP-A-62-200350, JP-A-62-206541 and JP-A-62-206543.

In one specific example, a low sensitivity blue-sensitive layer (BL)/a high sensitivity blue-sensitive layer (BH)/a high sensitivity green-sensitive layer (GH)/a low sensitivity green-sensitive layer (GL)/a high sensitivity red-sensitive layer (RH)/a low sensitivity red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement in which there are three layers having different degrees of sensitivities with the sensitivity being lower towards the support such that the upper layer is a silver halide emulsion layer having the highest sensitivity, the middle layer is a silver halide emulsion layer having a lower sensitivity than that of the upper layer, and the lower layer is a silver halide emulsion layer having a lower sensitivity than that of the middle layer, as disclosed in JP-B-49-15495. In the case of the structure of this type comprising three layers having different degrees of sensitivity, the layers in the unit layer of the same spectral sensitivity may be arranged in the order of a middle sensitivity emulsion layer/a high sensitivity emulsion layer/a low sensitivity emulsion layer, from the side farthest from the support, as disclosed in JP-A-59-202464.

Alternatively, the layers can be arranged in the order of a high sensitivity emulsion layer/a low sensitivity emulsion layer/a middle sensitivity emulsion layer, or a low sensitivity emulsion layer/a middle sensitivity emulsion layer/a high sensitivity emulsion layer. Moreover, the arrangement may be varied as indicated above in the case where there are four or more layers.

For improving color reproducibility, a donor layer (CL) for an interlayer effect having a different spectral sensitivity distribution from a main light-sensitive layer such as BL, GL and RL may preferably be provided adjacent or close to the main light-sensitive layer, as disclosed in U.S. Pat. Nos. 4,663,271, 4,705,744, 4,707,436, JP-A-62-160448 and JP-A-63-89850.

The silver halide preferably used in the present invention is silver iodobromide, silver iodochloride or silver iodochlorobromide containing about 30 mol % or less of silver iodide, and particularly preferably used is silver iodobromide or silver iodochlorobromide containing from about 2 mol % to about 10 mol % of silver iodide.

Silver halide grains in a photographic emulsion may have a regular crystal form such as a cubic, octahedral or tetradecahedral form, an irregular crystal form such as a spherical or plate-like form, a form which has crystal defects such as twin crystal planes, or a form which is a composite of these forms.

The silver halide grains may be a fine grain having a grain size of about 0.2 μm or less, or large size grains having a projected area diameter of up to about 10 μm, and the emulsion may be a polydisperse emulsion or a monodisperse emulsion.

The silver halide photographic emulsions for use in the present invention can be prepared using the methods disclosed, for example, in *Research Disclosure* (hereinafter abbreviated to *RD*), No. 17643 (December, 1978), pp. 22 and 23, "I. Emulsion Preparation and Types", *RD*, No. 18716 (November, 1979), p. 648, *RD*, No. 307105 (November, 1989), pp. 863 to 865, P. Glafkides, *Chimie et Physique Photographique*, Paul Montel (1967), G. F. Duffin, *Photographic Emulsion Chemistry*, Focal Press (1966), and V. L. Zelikman et al., *Making and Coating Photographic Emulsion*, Focal Press (1964).

The monodisperse emulsions disclosed in U.S. Pat. Nos. 3,574,628, 3,655,394 and British Patent 1,413,748 are also preferred.

Further, tabular grains having an aspect ratio of about 3 or more can also be used in the present invention. Tabular grains can be easily prepared according to the methods disclosed, for example, in Gutoff, *Photographic Science and Engineering*, Vol. 14, pp. 248 to 257 (1970), U.S. Pat. Nos. 4,434,226, 4,414,310, 4,433,048, 4,439,520 and British Patent 2,112,157.

The crystal structure may be uniform, or the interior and exterior parts of the grains may be comprised of different halogen compositions, or the grains may have a stratifying structure. Silver halides which have different compositions may be joined with an epitaxial junction or may be joined with compounds other than a silver halide, such as silver thiocyanate or lead oxide. Further, mixtures of grains which have various crystal forms may also be used.

The above-described emulsions may be of the superficial latent image type wherein the latent image is primarily formed on the surface, or of the internal latent image type wherein the latent image is formed within the grains, or of the type wherein the latent image is formed both at the surface and within the grains, but a negative type emulsion is requisite. Of the internal latent image types, the emulsion may be a core/shell type internal latent image type emulsion as disclosed in JP-A-63-264740, and a method for preparing such a core/shell type internal latent image type emulsion is disclosed in JP-A-59-133542. The thickness of the shell of this emulsion varies depending on the development process and the like, but is preferably from 3 to 40 nm, and particularly preferably from 5 to 20 nm.

The silver halide emulsion for use in the present invention is usually subjected to physical ripening, chemical ripening and spectral sensitization. Additives for use in such processes are disclosed in *RD*, No. 17643, *RD*, No. 18716, and *RD*, No. 307105, and the locations of these disclosures are summarized in a table below.

In the photographic material of the present invention, two or more different types of emulsions which are different in terms of at least one of the characteristics of grain size, grain size distribution, halogen composition, the form of the grains, or light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation thereof are disclosed in U.S. Pat. No. 4,626,498 and JP-A-59-214852. The silver halide which forms the internal nuclei of a core/shell type silver halide grains having a fogged grain interior may have different halogen compositions. The silver halide having a fogged grain interior or surface may be any of silver chloride, silver chlorobromide, silver iodobromide, or silver chloroiodobromide. The average grain size of these fogged silver halide grains is preferably from 0.01 to 0.75 μm, and particularly preferably from 0.05 to 0.6 μm. Further, the form of the grains may be regular grains and may be a polydisperse emulsion, but a monodisperse emulsion (at least 95% of silver halide grains thereof have a grain size within ±40% of the average grain size in terms of the weight or number of silver halide grains) is preferred.

The use of light-insensitive fine grained silver halides is preferred in the present invention. Light-insensitive fine grained silver halides are fine grained silver halides which are not sensitive to light upon imagewise exposure for obtaining color images and which do not substantially undergo development during development processing, and they are preferably not pre-fogged. Fine grained silver halide has a silver bromide content of from 0 to 100 mol %, and may contain silver chloride and/or silver iodide, if necessary. Fine grained silver halides which have a silver iodide content of from 0.5 to 10 mol % are preferred. The average grain size of fine grained silver halide (the average value of the diameters of the circles equivalent to the projected areas) is preferably from 0.01 to 0.5 μm, and more preferably from 0.02 to 0.2 μm.

Fine grained silver halide can be prepared by the same methods as the preparation of generally used light-sensitive silver halides. In the preparation of fine grained silver halide, the surface of silver halide grains does not need to be optically sensitized and also does not need to be spectrally sensitized. However, it is preferred to previously include known stabilizers such as triazole based, azaindene based, benzothiazolium based, or mercapto based compounds, or zinc compounds in fine grained silver halide before addition to the coating solution. Colloidal silver can be included in the layer containing fine grained silver halide grains.

The coating weight of silver in the photographic material of the present invention is preferably 6.0 g/m$^2$ or less, and most preferably 4.5 g/m$^2$ or less.

Photographic additives which can be used in the present invention are disclosed in *RD* and the locations related thereto are indicated in the table below.

TABLE 1

| Type of Additives | RD 17643 (Dec., 1978) | RD 18716 (Nov., 1979) | RD 307105 (Nov., 1989) |
|---|---|---|---|
| 1. Chemical Sensitizers | page 23 | page 648, right column | page 866 |
| 2. Sensitivity Increasing Agents | — | page 648, right column | — |
| 3. Spectral Sensitizers and Supersensitizers | pages 23–24 | page 648, right column to page 649, right column | pages 866–868 |
| 4. Brightening Agents | page 24 | page 647, right column | page 868 |
| 5. Antifoggants and Stabilizers | pages 24–25 | page 649, right column | pages 868–870 |
| 6. Light Absorbers, Filter Dyes, and Ultraviolet Absorbers | pages 25–26 | page 649, right column to page 650, left column | page 873 |
| 7. Antistaining Agents | page 25, right column | page 650, left to right columns | page 872 |
| 8. Dye image Stabilizers | page 25 | page 650, left column | page 872 |
| 9. Hardening Agents | page 26 | page 651, left column | pages 874–875 |
| 10. Binders | page 26 | page 651, left column | pages 873–874 |
| 11. Plasticizers and Lubricants | page 27 | page 650, right column | page 876 |
| 12. Coating Aids and Surfactants | pages 26–27 | page 650, right column | pages 875–876 |
| 13. Antistatic Agents | page 27 | page 650, right column | pages 876–877 |
| 14. Matting Agents | — | — | pages 878–879 |

Various dye-forming couplers can be used in the photographic material of the present invention, and the following couplers are particularly preferred.

Yellow Couplers:

The couplers represented by formula (I) or (II) disclosed in EP-A-502424; the couplers represented by formula (1) or (2) disclosed in EP-A-513496 (in particular, Y-28 on page 18); the couplers represented by formula (I) disclosed in claim 1 of EP-A-568037; the couplers represented by formula (I), lines 45 to 55, column 1 of U.S. Pat. No. 5,066,576; the couplers represented by formula (I), paragraph 0008 of JP-A-4-274425; the couplers disclosed in claim 1 on page 40 of EP-A-498381 (in particular, D-35 on page 18); the couplers represented by formula (Y) on page 4 of EP-A-447969 (in particular, Y-1 (page 17) and Y-54 (page 41)); and the couplers represented by any of formulae (II) to (IV), lines 36 to 58, column 7 of U.S. Pat. No. 4,476,219 (in particular, II-17 and II-19 (column 17), and II-24 (column 19)).

Magenta Couplers:

L-57 (page 11, right lower column), L-68 (page 12, right lower column), and L-77 (page 13, right lower column) of JP-A-3-39737; [A-4]-63 (page 134), and [A-4]-73 to [A-4]-75 (page 139) of EP-A-456257; M-4 to M-6 (page 26) and M-7 (page 27) of EP-A-486965; M-45 (page 19) of EP-A-571959; (M-1) (page 6) of JP-A-5-204106; and M-22, paragraph 0237 of JP-A-4-362631.

Cyan Couplers:

CX-1, CX-3, CX-4, CX-5, CX-11, CX-12, CX-14 and CX-15 (pages 14 to 16) of JP-A-4-204843; C-7 and C-10 (page 35), C-34 and C-35 (page 37), and (I-1) and (I-17) (pages 42 and 43) of JP-A-4-43345; and the couplers represented by formula (Ia) or (Ib) disclosed in claim 1 of JP-A-6-67385.

Polymer Couplers:

P-1 and P-5 (page 11) of JP-A-2-44345.

Couplers the Colored Dyes of Which Have Appropriate Diffusibility:

The couplers disclosed in U.S. Pat. No. 4,366,237, British Patent 2,125,570, EP-B-96873 and German Patent 3,234,533 are preferred as couplers the colored dyes of which have an appropriate diffusibility.

Couplers for Correcting the Unnecessary Absorption of Colored Dyes:

Examples of preferred couplers for correcting the unnecessary absorption of colored dyes include the yellow colored cyan couplers represented by formula (CI), (CII), (CIII) or (CIV) disclosed on page 5 of EP-A-456257 (in particular, YC-86 on page 84); the yellow colored magenta couplers ExM-7 (page 202), EX-1 (page 249), and EX-7 (page 251) disclosed in EP-A-456257; the magenta colored cyan couplers CC-9 (column 8) and CC-13 (column 10) disclosed in U.S. Pat. No. 4,833,069; the coupler (2) (column 8) of U.S. Pat. No. 4,837,136; and the colorless masking couplers represented by formula (A) disclosed in claim 1 of WO 92/11575 (in particular, the compounds disclosed on pages 36 to 45).

Examples of compounds (inclusive of couplers) which release photographically useful residual groups of compounds upon reacting with the oxidation product of a developing agent include the following:

Development Inhibitor-Releasing Compounds:

The compounds represented by formula (I), (II), (III) or (IV) disclosed on page 11 of EP-A-378236 (in particular, T-101 (page 30), T-104 (page 31), T-113 (page 36), T-131 (page 45), T-144 (page 51) and T-158 (page 58)); the compounds represented by formula (I) disclosed on page 7 of EP-A-436938 (in particular, D-49 (page 51)); the compounds represented by formula (I) disclosed in EP-A-568037 (in particular, (23) (page 11)); and the compounds represented by formula (I), (II) or (III) disclosed on pages 5 and 6 of EP-A-440195 (in particular, I-(1) on page 29);

Bleaching Accelerator-Releasing Compounds:

The compounds represented by formula (I) or (I') disclosed on page 5 of EP-A-310125 (in particular, (60) and

(61) on page 61); and the compounds represented by formula (I) disclosed in claim 1 of JP-A-6-59411 (in particular, (7) on page 7);

Ligand-Releasing Compounds:

The compounds represented by LIG-X disclosed in claim 1 of U.S. Pat. No. 4,555,478 (in particular, the compounds in lines 21 to 41, column 12);

Leuco Dye-Releasing Compounds:

Compounds 1 to 6, columns 3 to 8 of U.S. Pat. No. 4,749,641;

Fluorescent Dye-Releasing Compounds:

The compounds represented by COUP-DYE disclosed in claim 1 of U.S. Pat. No. 4,774,181 (in particular, compounds 1 to 11, columns 7 to 10);

Development Accelerator-Releasing or Fogging Agent-Releasing Compounds:

The compounds represented by formula (1), (2) or (3), column 3 of U.S. Pat. No. 4,656,123 (in particular, (I-22), column 25); and compound ExZK-2, lines 36 to 38, page 75 of EP-A-450637; and Compounds Which Release Dyes the Color of Which Is Restored after Elimination:

The compounds represented by formula (I) disclosed in claim 1 of U.S. Pat. No. 4,857,447 (in particular, Y-1 to Y-19, columns 25 to 36).

Preferred additives other than couplers are listed below:

Dispersion Mediums of Oil-Soluble Organic Compound:

P-3, P-5, P-16, P-19, P-25, P-30, P-42, P-49, P-54, P-55, P-66, P-81, P-85, P-86 and P-93 (pages 140 to 144) of JP-A-62-215272;

Latexes for Impregnation of Oil-Soluble Organic Compound:

The latexes disclosed in U.S. Pat. No. 4,199,363;

Scavengers for the Oxidation Product of Developing Agent:

The compounds represented by formula (I), lines 54 to 62, column 2 of U.S. Pat. No. 4,978,606 (in particular, I-(1), I-(2), I-(6) and I-(12), columns 4 and 5); and the compounds represented by the formula disclosed in lines 5 to 10, column 2 of U.S. Pat. No. 4,923,787 (in particular, compound 1, column 3);

Antistaining Agents:

The compounds represented by formula (I), (II) or (III), lines 30 to 33, page 4 of EP-A-298321 (in particular, I-47, I-72, III-1 and III-27, pages 24 to 48);

Discoloration Inhibitors:

A-6, A-7, A-20, A-21, A-23, A-24, A-25, A-26, A-30, A-37, A-40, A-42, A-48, A-63, A-90, A-92, A-94 and A-164 (pages 69 to 118) of EP-A-298321; II-1 to III-23, columns 25 to 38 of U.S. Pat. No. 5,122,444 (in particular, III-10); I-1 to III-4, pages 8 to 12 of EP-A-471347 (in particular, II-2); and A-1 to A-48, columns 32 to 40 of U.S. Pat. No. 5,139,931 (in particular, A-39 and A-42);

Compounds for Reducing the Using Amounts of Color Intensifiers and Color Mixing Preventives:

I-1 to II-15, pages 5 to 24 of EP-A-411324 (in particular, I-46);

Formaldehyde Scavengers:

SCV-1 to SCV-28, pages 24 to 29 of EP-A-477932 (in particular, SCV-8);

Hardening Agents:

H-1, H-4, H-6, H-8 and H-14 on page 17 of JP-A-1-214845; the compounds represented by any of formulae (VII) to (XII), columns 13 to 23 of U.S. Pat. No. 4,618,573 (H-1 to H-54); the compounds represented by formula (6), right lower column, page 8 of JP-A-2-214852 (H-1 to H-76) (in particular, H-14); and the compounds disclosed in claim 1 of U.S. Pat. No. 3,325,287;

Development Inhibitor Precursors:

P-24, P-37 and P-39, pages 6 and 7 of JP-A-62-168139; and the compounds disclosed in claim 1 of U.S. Pat. No. 5,019,492 (in particular, compounds 28 and 29, column 7);

Fungicides and Biocides:

I-1 to III-43, columns 3 to 15 of U.S. Pat. No. 4,923,790 (in particular, II-1, II-9, II-10, II-18 and III-25);

Stabilizers and Antifoggants:

I-1 to (14), columns 6 to 16 of U.S. Pat. No. 4,923,793 (in particular, I-1, 60, (2) and (13)); and compounds 1 to 65, columns 25 to 32 of U.S. Pat. No. 4,952,483 (in particular, compound 36);

Chemical Sensitizers:

Triphenylphosphine selenide; and compound 50 disclosed in JP-A-5-40324;

Dyes:

a-1 to b-20, pages 15 to 18 (in particular, a-1, a-12, a-18, a-27, a-35, a-36, and b-5), and V-1 to V-23, pages 27 to 29 (in particular, V-1) of JP-A-3-156450; F-I-1 to F-II-43, pages 33 to 55 of EP-A-445627 (in particular, F-I-11 and F-II-8); III-1 to III-36, pages 17 to 28 of EP-A-457153 (in particular, III-1 and III-3); crystallite dispersions of Dye-1 to Dye-124, pages 8 to 26 of WO 88/04794; compounds 1 to 22, pages 6 to 11 of EP-A-319999 (in particular, compound 1); compounds D-1 to D-87 represented by any of formulae (1) to (3), pages 3 to 28 of EP-A-519306; compounds 1 to 22 represented by formula (I), columns 3 to 10 of U.S. Pat. No. 4,268,622; and compounds (1) to (31) represented by formula (I), columns 2 to 9 of U.S. Pat. No. 4,923,788;

Ultraviolet Absorbers:

Compounds (18b) to (18r) represented by formula (I), 101 to 427, pages 6 to 9 of JP-A-46-3335; compounds (3) to (66) represented by formula (I), pages 10 to 44, and compounds HBT-1 to HBT-10 represented by formula (III), page 14, of EP-A-520938; and compounds (1) to (31) represented by formula (1), columns 2 to 9 of EP-A-521823.

Suitable supports which can be used in the present invention are disclosed, for example, in *RD*, No. 17643, p. 28, *RD*, No. 18716, from p. 647, right column to p. 648, left column, and *RD*, No. 307105, p. 879.

The photographic material of the present invention has a total film thickness of all the hydrophilic colloid layers on the side where the emulsion layers are located of preferably 28 μm or less, more preferably 23 μm or less, still more preferably 18 μm or less, and most preferably 16 μm or less. Further, the film swelling rate $T_{1/2}$ is preferably 30 seconds or less, more preferably 20 seconds or less. $T_{1/2}$ is defined as the time required for the film thickness to reach ½ of the saturated film thickness, taking 90% of the maximum swollen film thickness reached when being processed at 30° C. for 3 minutes and 15 seconds in a color developing solution as the saturated film thickness. The film thickness means the film thickness measured under the conditions of 25° C., 55% relative humidity (stored for two days), and $T_{1/2}$ can be measured using a swellometer of the type described in A. Green et al., *Photogr. Sci. Eng.*, Vol. 19, No. 2, pp. 124 to 129. $T_{1/2}$ can be adjusted by adding hardening agents to gelatin which is used as a binder, or by changing the aging conditions after coating. Further, a swelling factor of from 150% to 400% is preferred. The swelling factor can be calculated from the maximum swollen film thickness obtained under the conditions described above using the equation: (maximum swollen film thickness−film thickness)/film thickness.

The provision of hydrophilic colloid layers having a total dry film thickness of from 2 μm to 20 μm on the side of the support opposite to the side on which emulsion layers are provided (known as backing layers) is preferred in the photographic material of the present invention. The inclusion of the above described light absorbers, filter dyes, ultraviolet absorbers, antistatic agents, hardening agents, binders, plasticizers, lubricants, coating aids, and surfactants in the backing layers is preferred. The swelling factor of the backing layer is preferably from 150 to 500%.

The photographic material of the present invention can be development processed by the ordinary methods disclosed in *RD*, No. 17643, pp. 28 and 29, *RD*, No. 18716, from left column to right column, p. 651, and *RD*, No. 307105, pp. 880 and 881.

The color developing solution for use in the development processing of the photographic material of the present invention is preferably an alkaline aqueous solution which contains an aromatic primary amine color developing agent as a main component. Aminophenol based compounds are useful as the color developing agent, but the use of p-phenylenediamine based compounds is preferred, and representative examples thereof include the compounds disclosed in lines 43 to 52, page 28 of EP-A-556700. Two or more of these compounds can be used in combination according to purposes.

The color developing solution generally contains a pH buffer such as alkali metal carbonate, borate or phosphate, or a development inhibitor or an antifoggant such as chloride, bromide, iodide, benzimidazoles, benzothiazoles, or mercapto compounds. The color developing solution may also contain, if necessary, various preservatives such as hydroxylamine, diethylhydroxylamine, sulfite, hydrazines, e.g., N,N-bis-carboxymethylhydrazine, phenylsemicarbazides, triethanolamine and catecholsulfonic acids, an organic solvent such as ethylene glycol and diethylene glycol, a development accelerator such as benzyl alcohol, polyethylene glycol, quaternary ammonium salt, and amines, a dye-forming coupler, a competitive coupler, an auxiliary developing agent such as 1-phenyl-3-pyrazolidone, a thickener, and various chelating agents typified by aminopolycarboxylic acid, aminopolyphosphonic acid, alkylphosphonic acid, and phosphonocarboxylic acid, e.g., ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts of these acids.

Further, color development is generally carried out after black-and-white development in the case of reversal processing. In a black-and-white developing solution, known black-and-white developing agents such as dihydroxybenzenes, e.g., hydroquinone, 3-pyrazolidones, e.g., 1-phenyl-3-pyrazolidone, or aminophenols, e.g., N-methyl-p-aminophenol can be used alone or in combination. The pH of these color developing solution and black-and-white developing solution is generally from 9 to 12. The replenishing rate of these developing solutions depends on the color photographic material to be processed but, in general, it is 3 liters or less per square meter of the photographic material, and the amount can be reduced to 500 ml or less by reducing the bromide ion concentration in the replenisher. In the case when the replenishing rate is reduced, it is preferred to prevent evaporation and air oxidation of the solution by minimizing the area of contact of the solution with the air in the processing tank.

The processing effect by the contact of the photographic processing solution with the air in a processing tank can be evaluated by the following equation: Open factor=[Contact area of processing solution with air ($cm^2$)]÷[Volume of processing solution ($cm^3$)]. This open factor is preferably 0.1 or less, more preferably from 0.001 to 0.05. The method using a movable lid as disclosed in JP-A-1-82033 and the slit development processing method as disclosed in JP-A-63-216050 can be used as a means of reducing the open factor, as well as the provision of a shielding material such as a floating lid on the surface of the photographic processing solution in the processing tank. Reduction of the open factor is preferred not only in processes of color development and black-and-white development but also in all the succeeding processes such as bleaching, blixing, fixing, washing and stabilizing processes. Further, the replenishing rate can be reduced by suppressing the accumulation of the bromide ion in a developing solution.

The color development processing time is usually set between 2 and 5 minutes, but shorter processing time is available by raising the temperature and the pH and increasing the concentration of the color developing agent.

A photographic emulsion layer is generally bleaching processed after being color development processed. A bleaching process and a fixing process may be carried out at the same time (a blixing process) or may be performed separately. A processing method comprising carrying out a blixing process after a bleaching process can be adopted for further rapid processing. Also, processing in two successive blixing baths, a fixing process before a blixing process, or a bleaching process after a blixing process may optionally be selected according to purposes. Compounds of polyvalent metals such as iron(III), peracids, quinones, and nitro compounds are used as a bleaching agent. Representative examples of bleaching agents which are preferably used in the present invention include a complex salt such as organic complex salts of iron(III) with aminopolycarboxylic acids, e.g., ethylenediaminetetraacetic acid, diethylenetriaminepentaacetic acid, cyclohexanediaminetetraacetic acid, methyliminodiacetic acid, 1,3-diaminopropanetetraacetic acid, and glycol ether diaminetetraacetic acid, or citric acid, tartaric acid or malic acid. The use of aminopolycarboxylic acid iron(III) complex salts such as ethylenediaminetetraacetic acid iron(III) complex salts and 1,3-diaminopropanetetraacetic acid iron(III) complex salts is particularly preferred of them from the point of providing rapid processing and preventing environmental pollution. Further, aminopolycarboxylic acid iron(III) complex salts are particularly useful in both of a bleaching solution and a blixing solution. The pH of the bleaching solution or the blixing solution in which these aminopolycarboxylic acid iron(III) complex salts are included is generally from 4.0 to 8, but lower pH can be used to speed up the processing.

Bleaching accelerators can be used, if necessary, in a bleaching solution, a blixing solution, or prebaths thereof. Specific examples of useful bleaching accelerators are disclosed in the following publications: the compounds which have a mercapto group or a disulfido group disclosed in U.S. Pat. No. 3,893,858, German Patents 1,290,812, 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *RD*, No. 17129 (July, 1978); the thiazolidine derivatives disclosed in JP-A-50-140129; the thiourea derivatives disclosed in JP-B-45-8506, JP-A-52-20832, JP-A-53-32735, and U.S. Pat. No. 3,706,561; the iodides disclosed in German Patent 1,127,715 and JP-A-58-16235; the polyoxyethylene compounds disclosed in German Patents 966,410 and 2,748,430; the polyamine compounds disclosed in JP-B-45-

8836; other compounds disclosed in JP-A-49-40943, JP-A-49-59644, JP-A-53-94927, JP-A-54-35727, JP-A-55-26506 and JP-A-58-163940; and bromide ions. The compounds which have a mercapto group or a disulfido group are preferred from the point of providing large accelerating effect, and those disclosed in U.S. Pat. No. 3,893,858, German Patent 1,290,812 and JP-A-53-95630 are particularly preferred of all. Further, the compounds disclosed in U.S. Pat. No. 4,552,834 are also preferred. These bleaching accelerators can be included in photographic materials. These bleaching accelerators are especially effective when color photographic materials for photographing are blixed.

It is preferred to include organic acids in a bleaching solution and a blixing solution, in addition to the above compounds, for inhibiting bleaching stain. Particularly preferred organic acids are compounds having an acid dissociation constant (pKa) of from 2 to 5, specifically, acetic acid, propionic acid, and hydroxyacetic acid are preferred.

Thiosulfate, thiocyanate, thioether based compounds, thioureas, and a large amount of iodide are cited as a fixing agent for use in a fixing solution and a blixing solution, but thiosulfate is generally used, in particular, ammonium thiosulfate can be most widely used. Further, the combined use of thiosulfate with thiocyanate, thioether based compounds and thiourea is also preferred. As preservatives for a fixing solution and a blixing solution, sulfite, bisulfite, bisulfite addition products of carbonyl or the sulfinic acid compounds disclosed in EP-A-294769 are preferred. Moreover, aminopolycarboxylic acids and organic phosphonic acids are preferably added to a fixing solution and a blixing solution for stabilizing the solutions.

In the present invention, compounds having a pKa of from 6.0 to 9.0 are preferably added to a fixing solution or a blixing solution for adjusting pH, preferably imidazoles such as imidazole, 1-methylimidazole, 1-ethylimidazole and 2-methylimidazole, in an amount of from 0.1 to 10 mol per liter.

The total processing time of the desilvering process is preferably shorter in the range not generating a desilvering failure. The desilvering processing time is preferably from 1 minute to 3 minutes and more preferably from 1 minute to 2 minutes. Further, the processing temperature is generally from 25° C. to 50° C., and preferably from 35° C. to 45° C. In the preferred temperature range, the desilvering rate is increased and the occurrence of staining after processing is effectively prevented.

Stirring as vigorous as possible in the desilvering process is preferred. Specific examples of the methods of forced stirring include the method wherein a jet of the processing solution is impinged on the surface of the emulsion of the photographic material as disclosed in JP-A-62-183460, the method wherein the stirring effect is raised using a rotating means as disclosed in JP-A-62-183461, the method wherein the photographic material is moved with a wiper blade, which is installed in the solution, in contact with the surface of the emulsion, and the generated turbulent flow at the surface of the emulsion increases the stirring effect, and the method wherein the circulating flow rate of the entire processing solution is increased. These means for increasing the stirring level are effective for the bleaching solution, the blixing solution and the fixing solution. It is supposed that the increased stirring level increases the rate of supply of the bleaching agent and the fixing agent to the emulsion film and, as a result, increases the desilvering rate. Further, the above means of increasing stirring are more effective when a bleaching accelerator is used, and it is possible to extremely increase the bleaching accelerating effect and to eliminate the fixing hindrance action due to the bleaching accelerator.

The automatic processors which are used in the present invention preferably have the means of transporting photographic materials as disclosed in JP-A-60-191257, JP-A-60-191258, and JP-A-60-191259. As described in the above JP-A-60-191257, such a transporting means can greatly reduce the carryover of the processing solution from the previous bath to the next bath and effectively prevent the deterioration of the capabilities of the processing solution, and is especially effective in reducing the processing time of each processing step and reducing the replenishing rate of each processing solution.

The photographic material of the present invention is generally subjected to a washing step and/or a stabilizing step after the desilvering step. The amount of the washing water in the washing step can be selected from a wide range according to the properties and the application of the photographic materials (for example, the materials used such as couplers, etc.), the temperature of the washing water, the number of washing tanks (the number of washing stages), the replenishing system, that is, whether a countercurrent system or a concurrent system, and other various conditions. Of the foregoing conditions, the relationship between the number of washing tanks and the amount of the water in a multistage countercurrent system can be obtained by the method described in *Journal of the Society of Motion Picture and Television Engineers*, Vol. 64, pp. 248 to 253 (May, 1955). According to the multistage countercurrent system of the above literature, the amount of the washing water can be greatly reduced, however, problems arise such that bacteria proliferate due to the increased residence time of the water in the tanks, and suspended matters produced thereby adhere to the photographic material. The method of reducing the calcium ion and magnesium ion concentrations as disclosed in JP-A-62-288838 can be used as a very effective means for overcoming these problems. Also, the isothiazolone compounds and the thiabendazoles as disclosed in JP-A-57-8542, the chlorine based antibacterial agents such as chlorinated sodium isocyanurate, the benzotriazoles, and the antibacterial agents disclosed in Hiroshi Horiguchi, *Bohkin Bohbai no Kagaku* (*Antibacterial and Antifungal Chemistry*), published by Sankyo Shuppan K.K. (1986), *Biseibutsu no Mekkin, Sakkin, Bohbai Gijutsu* (*Germicidal and Antifungal Techniques of Microorganisms*), edited by Eisei Gijutsukai, published by Kogyo Gijutsukai (1982), and *Bohkin Bohbai Zai Jiten* (*Antibacterial and Antifungal Agents Thesaurus*), edited by Nippon Bohkin Bohbai Gakkai (1986), can be used.

The pH of the washing water in the processing of the photographic material of the present invention is generally from 4 to 9 and preferably from 5 to 8. The temperature and the time of the washing step can be selected variously according to the characteristics and the end use purpose of the photographic material to be processed, but is generally from 15 to 45° C. for 20 seconds to 10 minutes, and preferably from 25 to 40° C. for 30 seconds to 5 minutes. Further, the photographic material of the present invention can be processed directly with a stabilizing solution without employing the washing step as described above. Any known methods as disclosed in JP-A-57-8543, JP-A-58-14834 and JP-A-60-220345 can be used in such a stabilizing process.

Further, there is also a case in which a stabilizing process is carried out following the above described washing process, and the stabilizing bath which contains a dye stabilizer and a surfactant which is used as a final bath for color photographic materials for photographing is one example of such a process. Aldehydes such as formaldehyde and glutaraldehyde, N-methylol compounds, hexamethylenetetramine and sulfite addition products of aldehyde can be used as a dye stabilizer. Various chelating agents and fungicides can also be added to this stabilizing bath.

The overflow generated by the replenishment of the above-described washing water and/or stabilizing solution can be reused in other steps such as a desilvering step, etc.

When the above each processing solution is concentrated due to the evaporation by the processing using an automatic processor, etc., it is preferred to replenish an appropriate amount of water for the correction of concentration.

Color developing agents may be incorporated into a photographic material of the present invention to simplify and speed up the processing. Color developing agent precursors are preferred for the incorporation. For example, the indoaniline based compounds disclosed in U.S. Pat. No. 3,342,597, the Schiff's base type compounds disclosed in U.S. Pat. No. 3,342,599, *Research Disclosure*, Nos. 14850 and 15159, the aldol compounds disclosed in *RD*, No. 13924, the metal complex salts disclosed in U.S. Pat. No. 3,719,492 and the urethane based compounds disclosed in JP-A-53-135628 can be used for this purpose.

Various 1-phenyl-3-pyrazolidones may be included, if required, in the photographic material of the present invention to accelerate color development. Typical compounds are disclosed in JP-A-56-64339, JP-A-57-144547 and JP-A-58-115438.

The processing solutions used for the processing of the photographic material of the present invention are used at a temperature of from 10° C. to 50° C. The standard temperature is generally from 33° C. to 38° C., but higher temperatures can be used to accelerate the processing to shorten the processing time, on the contrary, lower temperatures can be used to improve the picture quality and stabilize the processing solutions.

The present invention is preferably applied to a silver halide photographic material having a transparent magnetic recording layer. The polyester laminar supports which have been previously heat-treated disclosed in detail in JP-A-6-35118, JP-A-6-17528 and Hatsumei-Kyokai Kokai Giho No. 94-6023, e.g., polyethylene aromatic dicarboxylate based polyester supports having a thickness of from 50 to 300 $\mu$m, preferably from 50 to 200 $\mu$m, more preferably from 80 to 115 $\mu$m, and particularly preferably from 85 to 105 $\mu$m, annealed at 40° C. or more and the glass transition point temperature or less for from 1 to 1,500 hours, are preferably used for silver halide photographic materials having a magnetic recording layer for use in the present invention. The above-described supports can be subjected to a surface treatment such as an ultraviolet irradiation treatment as disclosed in JP-B-43-2603, JP-B-43-2604 and JP-B-45-3828, a corona discharge treatment as disclosed in JP-B-48-5043 and JP-A-51-131576, and a glow discharge treatment as disclosed in JP-B-35-7578 and JP-B-46-43480, undercoated as disclosed in U.S. Pat. No. 5,326,689, provided with an underlayer as disclosed in U.S. Pat. No. 2,761,791, if necessary, and coated with ferromagnetic grains as disclosed in JP-A-59-23505, JP-A-4-195726 and JP-A-6-59357.

The above-described magnetic layer may be provided on a support in stripe as disclosed in JP-A-4-124642 and JP-A-4-124645.

Further, the supports are subjected to an antistatic treatment, if necessary, as disclosed in JP-A-4-62543, and finally coated with silver halide photographic emulsion. The silver halide emulsions disclosed in JP-A-4-166932, JP-A-3-41436 and JP-A-3-41437 are used herein.

The photographic material of the present invention is preferably manufactured according to the manufacturing and controlling methods as disclosed in JP-B-4-86817 and manufacturing data are recorded according to the methods disclosed in JP-B-6-87146. Before or after that, according to the methods disclosed in JP-A-4-125560, the photographic material is cut to a film of a narrower width than that of a conventional 135 size film and two perforations are made on one side per a smaller format picture plane so as to match with the smaller format picture plane than the picture plane heretofore in use.

The thus-produced film can be loaded and used in the cartridge packages disclosed in JP-A-4-157459, the cartridge disclosed in FIG. 9 in Example of JP-A-5-210202, the film patrones disclosed in U.S. Pat. No. 4,221,479, and the cartridges disclosed in U.S. Pat. Nos. 4,834,306, 4,834,366, 5,226,613 and 4,846,418.

Film cartridges and film patrones of the type which can encase a film tip as disclosed in U.S. Pat. Nos. 4,848,693 and 5,317,355 are preferred in view of the light shielding capability.

Further, a cartridge which has a locking mechanism as disclosed in U.S. Pat. No. 5,296,886, a cartridge which has the displaying function of working conditions, and a cartridge which has the function of preventing double exposure as disclosed in U.S. Pat. No. 5,347,334 are preferred.

In addition, a cartridge by which a film can be easily loaded only by inserting a film into a cartridge as disclosed in JP-A-6-85128 may be used.

The thus-produced film cartridges can be used for various photographic pleasures such as photographing and development processing using the following cameras, developing machines, and laboratory devices according to purposes.

The functions of film cartridges (patrones) can be sufficiently demonstrated using, for example, the easily loadable camera disclosed in JP-A-6-8886 and JP-A-6-99908, the automatic winding type camera disclosed in JP-A-6-57398 and JP-A-6-101135, the camera capable of pulling out the film and exchanging for a different kind of film in the course of photographing disclsoed in JP-A-6-205690, the camera which can magnetically record the information at photographing time such as panorama photographing, high vision photographing or general photographing (capable of magnetic recording which can set up the print aspect ratio) disclosed in JP-A-5-293138 and JP-A-5-283382, the camera having the function of preventing double exposure disclosed in JP-A-6-101194, and the camera having the displaying function of working conditions of a film and the like disclosed in JP-A-5-150577.

The thus-photographed films may be processed using the automatic processors disclosed in JP-A-6-222514 and JP-A-6-222545, the using methods of the magnetically recording information on the film disclosed in JP-A-6-95265 and JP-A-4-123054 may be used before, during or after processing, or the function of selecting the aspect ratio disclosed in JP-A-5-19364 can be used.

If development processing is motion picture type development, the film is processed by splicing according to the method disclosed in JP-A-5-119461.

Further, during or after development processing, the attachment and detachment disclosed in JP-A-6-148805 are conducted.

After processing has been conducted thus, the information on the film may be altered to a print through back printing and front printing to a color paper according to the methods disclosed in JP-A-2-184835, JP-A-4-186335 and JP-A-6-79968.

The film may be returned to a customer with the index print disclosed in JP-A-5-11353 and JP-A-5-232594 and the return cartridge.

The present invention will be illustrated in more detail with reference to examples below, but these are not to be construed as limiting the invention.

EXAMPLE 1

(1) Preparation of Emulsion

A 14% aqueous solution of potassium bromide and a 20% aqueous solution of silver nitrate were added by a double jet method at a constant flow rate over one minute at 55° C., pBr 1.0, with well stirring, to an aqueous solution of 3.7 liters of distilled water having dissolved therein 6 g of potassium bromide and 30 g of inert gelatin having an average molecular weight of 15,000 (2.4% of the entire silver amount was consumed by this addition).

A gelatin aqueous solution (17%, 300 cc) was added to the solution, after stirring at 55° C., a 20% aqueous solution of silver nitrate was added at a constant flow rate until the pBr reached 1.4 (5.0% of the entire silver amount was consumed by this addition). Subsequently, $1.2\times10^{-5}$ mol per mol of silver of thiourea dioxide was added, further, a 20% aqueous solution of potassium iodobromide ($KBr_{1-x}I_x$: x=0.04) and a 33% aqueous solution of silver nitrate were added by a double jet method over 43 minutes (50% of the entire silver amount was consumed by this addition). After $2.5\times10^{-4}$ mol per mol of silver of sodium ethylthiosulfonate was added, an aqueous solution containing 8.3 g of potassium iodide was added, further, 14.5 ml of an aqueous solution containing 0.001 wt % of $K_3IrCl_6$ was added followed by the addition of a 20% solution of potassium bromide and a 33% aqueous solution of silver nitrate by a double jet method over 39 minutes (42.6% of the entire silver amount was consumed by this addition). The amount of silver nitrate used in this emulsion was 425 g. The emulsion was desalted by ordinary flocculation and pAg and pH were adjusted to 8.2 and 5.8, respectively, at 40° C. Tabular silver iodobromide emulsion (Em-1) having an average aspect ratio of 6.5, variation coefficient of 18%, and sphere equivalent diameter of 0.8 $\mu$m was prepared. Dislocation lines were observed in the vicinity of the periphery of the tabular grain on an average of 50 or more per one grain by a transmission type electron microscope of 200 kV at liquid $N_2$ temperature.

The sensitizing dye shown in Table 3 was added to the thus-prepared Emulsion Em-1 in the amount shown in Table 3, succeedingly, Emulsion Em-1 was optimally gold-seleniumsulfur sensitized by the addition of sodium thiosulfate, chloroauric acid, N,N-dimethylselenourea and potassium thiocyanate to prepare Emulsions 151 to 172. Tabular silver iodobromide emulsion (Em-2) was prepared by excluding the step of adding thiourea dioxide and sodium ethylthiosulfonate from the above prescription of emulsion preparation. Each sensitizing dye shown in Table 2 was added to Em-2 and Emulsions 101 to 122 were prepared.

An emulsion layer and a protective layer were coated on a triacetyl cellulose support having an undercoat layer in the amount indicated in Table 4 and Sample Nos. 1001 to 1072 were prepared.

TABLE 2

| Emulsion Prepared | | |
|---|---|---|
| Emulsion No. | Sensitizing Dye | Remarks (not reduced) |
| 101 | (SD-1) ($4.6\times10^{-4}$ mol/mol Ag) | Comparison |
| 102 | (17) ($4.6\times10^{-4}$ mol/mol Ag) | " |
| 103 | (16) ($4.6\times10^{-4}$ mol/mol Ag) | " |
| 104 | (15) ($4.6\times10^{-4}$ mol/mol Ag) | " |

TABLE 2-continued

| Emulsion Prepared | | |
|---|---|---|
| Emulsion No. | Sensitizing Dye | Remarks (not reduced) |
| 105 | (14) ($4.6\times10^{-4}$ mol/mol Ag) | " |
| 106 | (12) ($4.6\times10^{-4}$ mol/mol Ag) | " |
| 107 | (19) ($4.6\times10^{-4}$ mol/mol Ag) | " |
| 108 | (11) ($4.6\times10^{-4}$ mol/mol Ag) | " |
| 109 | (SD-2) ($4.6\times10^{-4}$ mol/mol Ag) | " |
| 110 | (30) ($4.6\times10^{-4}$ mol/mol Ag) | " |
| 111 | (26) ($4.6\times10^{-4}$ mol/mol Ag) | " |
| 112 | (23) ($4.6\times10^{-4}$ mol/mol Ag) | " |
| 113 | (24) ($4.6\times10^{-4}$ mol/mol Ag) | " |
| 114 | (22) ($4.6\times10^{-4}$ mol/mol Ag) | " |
| 115 | (28) ($4.6\times10^{-4}$ mol/mol Ag) | " |
| 116 | (21) ($4.6\times10^{-4}$ mol/mol Ag) | " |
| 117 | (SD-3) ($4.6\times10^{-4}$ mol/mol Ag) | " |
| 118 | (33) ($4.6\times10^{-4}$ mol/mol Ag) | " |
| 119 | (SD-4) ($4.6\times10^{-4}$ mol/mol Ag) | " |
| 120 | (37) ($4.6\times10^{-4}$ mol/mol Ag) | " |
| 121 | (SD-5) ($4.6\times10^{-4}$ mol/mol Ag) | " |
| 122 | (38) ($4.6\times10^{-4}$ mol/mol Ag) | " |

TABLE 3

| Emulsion Prepared | | |
|---|---|---|
| Emulsion No. | Sensitizing Dye | Remarks (not reduced) |
| 151 | (SD-1) ($4.6\times10^{-4}$ mol/mol Ag) | Comparison |
| 152 | (17) ($4.6\times10^{-4}$ mol/mol Ag) | Invention |
| 153 | (16) ($4.6\times10^{-4}$ mol/mol Ag) | " |
| 154 | (15) ($4.6\times10^{-4}$ mol/mol Ag) | " |
| 155 | (14) ($4.6\times10^{-4}$ mol/mol Ag) | " |
| 156 | (12) ($4.6\times10^{-4}$ mol/mol Ag) | " |
| 157 | (19) ($4.6\times10^{-4}$ mol/mol Ag) | " |
| 158 | (11) ($4.6\times10^{-4}$ mol/mol Ag) | " |
| 159 | (SD-2) ($4.6\times10^{-4}$ mol/mol Ag) | Comparison |
| 160 | (30) ($4.6\times10^{-4}$ mol/mol Ag) | Invention |
| 161 | (26) ($4.6\times10^{-4}$ mol/mol Ag) | " |
| 162 | (23) ($4.6\times10^{-4}$ mol/mol Ag) | " |
| 163 | (24) ($4.6\times10^{-4}$ mol/mol Ag) | " |
| 164 | (22) ($4.6\times10^{-4}$ mol/mol Ag) | " |
| 165 | (28) ($4.6\times10^{-4}$ mol/mol Ag) | " |
| 166 | (21) ($4.6\times10^{-4}$ mol/mol Ag) | " |
| 167 | (SD-3) ($4.6\times10^{-4}$ mol/mol Ag) | Comparison |
| 168 | (33) ($4.6\times10^{-4}$ mol/mol Ag) | Invention |
| 169 | (SD-4) ($4.6\times10^{-4}$ mol/mol Ag) | Comparison |
| 170 | (37) ($4.6\times10^{-4}$ mol/mol Ag) | Invention |
| 171 | (SD-5) ($4.6\times10^{-4}$ mol/mol Ag) | Comparison |
| 172 | (38) ($4.6\times10^{-4}$ mol/mol Ag) | Invention |

TABLE 4
Emulsion Coating Condition
(1) Emulsion Layer
- Emulsion: Emulsions 101 to 125, 151/175 (silver, $2.1 \times 10^{-2}$ mol/m$^2$)
- Coupler ($1.5 \times 10^{-3}$ mol/m$^2$)
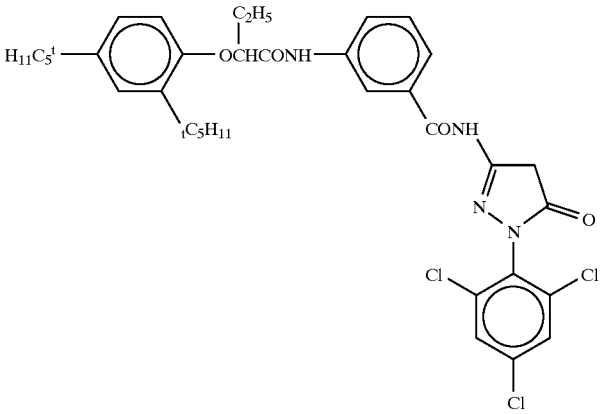
- Tricresyl phosphate (1.10 g/m$^2$)
- Gelatin (2.30 g/m$^2$)
(2) Protective Layer
- Sodium 2,4-dichlorotriazine-6-hydroxy-s-triazine (0.08 g/m$^2$)
- Gelatin (1.80 g/m$^2$)
SD-1
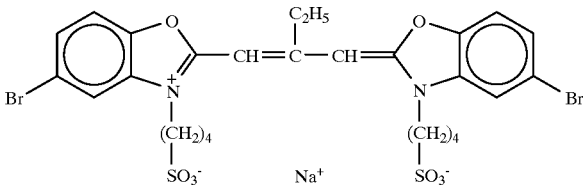
SD-2
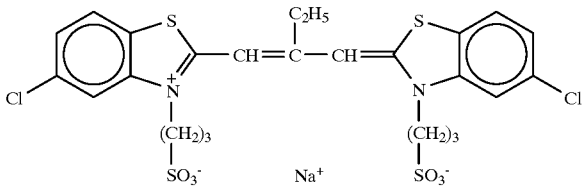
SD-3
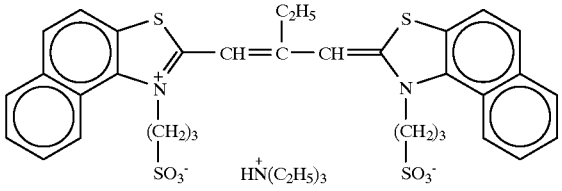
SD-4
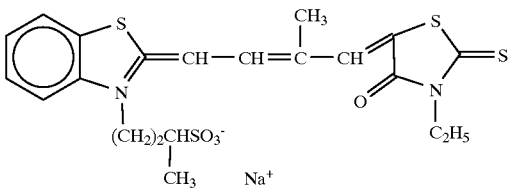

TABLE 4-continued

Emulsion Coating Condition

SD-5

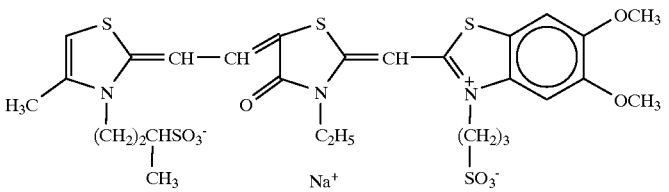

Each of these samples was subjected to sensitometric exposure for 1/100 sec. at color temperature of 4,800° K through a continuous wedge and gelatin filter SC-50 (a product of Fuji Photo Film Co., Ltd.), and color development processed at 38° C. by the following condition.

Processing Step

| Step | Processing Time | Processing Temperature (° C.) | Replenishment Rate* (ml) | Tank Capacity (liter) |
|---|---|---|---|---|
| Color Development | 2 min 45 sec | 38 | 33 | 20 |
| Bleaching | 6 min 30 sec | 38 | 25 | 40 |
| Washing | 2 min 10 sec | 24 | 2,100 | 20 |
| Fixing | 4 min 20 sec | 38 | 25 | 30 |
| Stabilization (1) | 1 min 05 sec | 24 | counter-current systen from (2) to (1) | 10 |
| Stabilization (2) | 1 min 00 sec | 24 | 1,200 | 10 |
| Stabilization (3) | 1 min 05 sec | 38 | 25 | 10 |
| Drying | 4 min 20 sec | 55 | | |

Replenishment rate: per 1 meter of 35 mm wide

The composition of each processing solution is described below.

| | Mother Solution (g) | Replenisher (g) |
|---|---|---|
| Color Developing Solution | | |
| Diethylenetriaminepentaacetic Acid | 1.0 | 1.1 |
| 1-Hydroxyethylidene-1,1-diphosphonic Acid | 3.0 | 3.2 |
| Sodium Sulfite | 4.0 | 4.4 |
| Potassium Carbonate | 30.0 | 37.0 |
| Potassium Bromide | 1.4 | 0.7 |
| Potassium Iodide | 1.5 mg | — |
| Hydroxylamine Sulfate | 2.4 | 2.8 |
| 4-(N-Ethyl-N-β-hydroxyethyl-amino)-2-methylaniline Sulfate | 4.5 | 5.5 |
| Water to make | 1.0 l | 1.0 l |
| pH | 10.05 | 10.10 |
| Bleaching Solution | | |
| Sodium Ethylenediaminetetra-acetato Ferrate Trihydrite | 100.0 | 120.0 |
| Disodium Ethylenediamine-tetraacetate | 10.0 | 11.0 |
| Ammonium Bromide | 140.0 | 160.0 |
| Ammonium Nitrate | 30.0 | 35.0 |
| Aqueous Ammonia (27%) | 6.5 ml | 4.0 ml |

-continued

| | Mother Solution (g) | Replenisher (g) |
|---|---|---|
| Water to make | 1.0 l | 1.0 l |
| pH | 6.0 | 5.7 |
| Fixing Solution | | |
| Sodium Ethylenediaminetetra-acetate | 0.5 | 0.7 |
| Sodium Sulfite | 7.0 | 8.0 |
| Sodium Bisulfite | 5.0 | 5.5 |
| Aqueous Solution of Ammonium Thiosulfate (70%) | 170.0 ml | 200.0 ml |
| Water to make | 1.0 l | 1.0 l |
| pH | 6.7 | 6.6 |
| Stabilizing Solution | | |
| Formalin (37%) | 2.0 ml | 3.0 ml |
| Polyoxyethylene-p-monononyl-phenyl Ether (polymerization degree: 10) | 0.3 | 0.45 |
| Disodium Ethylenediaminetetra-acetate | 0.05 | 0.08 |
| Water to make | 1.0 l | 1.0 l |
| pH | 5.8–8.0 | 5.8–8.0 |

Density of the processed sample was measured.

The reciprocal of the exposure amount required to give an optical density of fog +0.2 was taken as fresh sensitivity and this is shown as relative sensitivity. Further, unexposed film was aged at 60° C., 60% RH for three days, subjected to exposure and development processed in the same manner, then sensitivity and fog were evaluated in the same manner.

The results obtained are shown in Tables 5 and 6. Sample No. 1001 was taken as control of sensitivity (100).

TABLE 5

| | | Fresh | | Aged | | |
|---|---|---|---|---|---|---|
| Sample No. | Emulsion Used | Relative Sensitivity | Fog | Relative Sensitivity | Fog | Remarks (not reduced) |
| 1001 | 101 | 100 (control) | 0.22 | 74 | 0.46 | Comparison |
| 1002 | 102 | 99 | 0.21 | 75 | 0.45 | " |
| 1003 | 103 | 100 | 0.23 | 76 | 0.46 | " |
| 1004 | 104 | 102 | 0.21 | 75 | 0.43 | " |
| 1005 | 105 | 97 | 0.21 | 73 | 0.46 | " |
| 1006 | 106 | 100 | 0.23 | 72 | 0.45 | " |
| 1007 | 107 | 98 | 0.21 | 74 | 0.43 | " |
| 1008 | 108 | 99 | 0.23 | 73 | 0.43 | " |
| 1009 | 109 | 102 | 0.23 | 75 | 0.65 | " |
| 1010 | 110 | 103 | 0.23 | 75 | 0.70 | " |
| 1011 | 111 | 97 | 0.23 | 74 | 0.71 | " |

TABLE 5-continued

| Sample No. | Emulsion Used | Fresh Relative Sensitivity | Fresh Fog | Aged Relative Sensitivity | Aged Fog | Remarks (not reduced) |
|---|---|---|---|---|---|---|
| 1012 | 112 | 99 | 0.22 | 73 | 0.66 | " |
| 1013 | 113 | 100 | 0.21 | 72 | 0.65 | " |
| 1014 | 114 | 102 | 0.22 | 73 | 0.65 | " |
| 1015 | 115 | 99 | 0.22 | 72 | 0.66 | " |
| 1016 | 116 | 98 | 0.23 | 73 | 0.64 | " |
| 1017 | 117 | 93 | 0.41 | 71 | 0.58 | " |
| 1018 | 118 | 93 | 0.41 | 71 | 0.58 | " |
| 1019 | 119 | 92 | 0.43 | 73 | 0.31 | " |
| 1020 | 120 | 91 | 0.43 | 72 | 0.31 | " |
| 1021 | 121 | 91 | 0.32 | 75 | 0.52 | " |
| 1022 | 122 | 92 | 0.33 | 75 | 0.51 | " |

TABLE 6

| Sample No. | Emulsion Used | Fresh Relative Sensitivity | Fresh Fog | Aged Relative Sensitivity | Aged Fog | Remarks (reduced) |
|---|---|---|---|---|---|---|
| 1051 | 151 | 104 | 0.41 | 49 | 1.44 | Comparison |
| 1052 | 152 | 151 | 0.25 | 131 | 0.33 | Invention |
| 1053 | 153 | 152 | 0.25 | 131 | 0.32 | " |
| 1054 | 154 | 151 | 0.24 | 130 | 0.32 | " |
| 1055 | 155 | 161 | 0.22 | 155 | 0.30 | " |
| 1056 | 156 | 164 | 0.21 | 160 | 0.30 | " |
| 1057 | 157 | 168 | 0.21 | 164 | 0.29 | " |
| 1058 | 158 | 173 | 0.20 | 170 | 0.29 | " |
| 1059 | 159 | 99 | 0.40 | 45 | 0.90 | Comparison |
| 1060 | 160 | 145 | 0.21 | 120 | 0.30 | Invention |
| 1061 | 161 | 146 | 0.21 | 121 | 0.30 | " |
| 1062 | 162 | 143 | 0.20 | 120 | 0.31 | " |
| 1063 | 163 | 171 | 0.15 | 158 | 0.28 | " |
| 1064 | 164 | 174 | 0.15 | 165 | 0.27 | " |
| 1065 | 165 | 181 | 0.14 | 173 | 0.26 | " |
| 1066 | 166 | 190 | 0.14 | 185 | 0.26 | " |
| 1067 | 167 | 101 | 0.54 | 45 | 1.10 | Comparison |
| 1068 | 168 | 191 | 0.21 | 184 | 0.35 | Invention |
| 1069 | 169 | 99 | 0.53 | 43 | 1.10 | Comparison |
| 1070 | 170 | 185 | 0.19 | 175 | 0.40 | Invention |
| 1071 | 171 | 94 | 0.51 | 35 | 1.03 | Comparison |
| 1072 | 172 | 184 | 0.19 | 175 | 0.41 | Invention |

It is clearly understood from the results in Tables 5 and 6 that the dyes according to the present invention are conspicuously high sensitive and cause less fog in reduction sensitized emulsion and excellent in storage stability. Specifically, in emulsions not reduction sensitized in Table 5, notwithstanding the dyes according to the present invention and the comparative dyes are equal in sensitivity and storability, in reduction sensitized emulsions in Table 6, the dyes according to the present invention are astonishingly high sensitive and excellent in storage stability.

EXAMPLE 2

A multilayer color photographic material was prepared by coating each layer having the following composition on an undercoated cellulose triacetate film support.

Composition of Light-Sensitive Layer

The main components for use in each layer are classified as follows:

ExC: Cyan Coupler

ExM: Magenta Coupler

ExY: Yellow Coupler

ExS: Sensitizing Dye

UV: Ultraviolet Absorber

HBS: High Boiling Point Organic Solvent

H: Hardening Agent for Gelatin

The numeral corresponding to each component indicates the coated weight in unit of g/m$^2$, and the coated weight of silver halide is shown as the calculated weight of silver. Further, in the case of a sensitizing dye, the coated weight is indicated in unit of mol per mol of silver halide in the same layer.

| First Layer: Antihalation Layer | |
|---|---|
| Black Colloidal Silver | 0.09 as silver |
| Gelatin | 1.60 |
| ExM-1 | 0.12 |
| ExF-1 | $2.0 \times 10^{-3}$ |
| Solid Dispersion Dye ExF-2 | 0.030 |
| Solid Dispersion Dye ExF-3 | 0.040 |
| HBS-1 | 0.15 |
| HBS-2 | 0.02 |
| **Second Layer: Interlayer** | |
| Silver Iodobromide Emulsion M | 0.065 as silver |
| ExC-2 | 0.04 |
| Polyethyl Acrylate Latex | 0.20 |
| Gelatin | 1.04 |
| **Third Layer: Low Sensitivity Red-Sensitive Emulsion Layer** | |
| Silver Iodobromide Emulsion A | 0.25 as silver |
| Silver Iodobromide Emulsion B | 0.25 as silver |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| **Fourth Layer: Middle Sensitivity Red-Sensitive Emulsion Layer** | |
| Silver Iodobromide Emulsion C | 0.70 as silver |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| **Fifth Layer: High Sensitivity Red-Sensitive Emulsion Layer** | |
| Silver Iodobromide Emulsion D | 1.40 as silver |
| As shown in TABLE 8, the dye of Emulsion 109 [(SD-2) ($4.6 \times 10^{-4}$ mol/mol Ag)] + the dye of Emulsion 117 [(SD-3) ($0.5 \times 10^{-4}$ mol/mol Ag)], or the dye of Emulsion 116 [(21) ($4.6 \times 10^{-4}$ mol/mol Ag)] + the dye of Emulsion 118 [(33) ($0.5 \times 10^{-4}$ mol/mol Ag)] was used. | |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| **Sixth Layer: Interlayer** | |
| Cpd-1 | 0.090 |
| Solid Dispersion Dye ExF-4 | 0.030 |
| HBS-1 | 0.050 |
| Polyethyl Acrylate Latex | 0.15 |
| Gelatin | 1.10 |

-continued

| Seventh Layer: Low Sensitivity Green-Sensitive Emulsion Layer | |
|---|---|
| Silver Iodobromide Emulsion E | 0.15 as silver |
| Silver Iodobromide Emulsion F | 0.10 as silver |
| Silver Iodobromide Emulsion G | 0.10 as silver |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |
| **Eighth Layer: Middle Sensitivity Green-Sensitive Emulsion Layer** | |
| Silver Iodobromide Emulsion H | 0.80 as silver |
| ExS-4 | $3.2 \times 10^{-4}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| **Ninth Layer: High Sensitivity Green-Sensitive Emulsion Layer** | |
| Silver Iodobromide Emulsion I | 1.25 as silver |
| As shown in TABLE 8, the dye of Emulsion 101 (SD-1) and the dye of Emulsion 108 (11) were used in an amount of $4.6 \times 10^{-4}$ mol/mol Ag, respectively. | |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Polyethyl Acrylate Latex | 0.15 |
| Gelatin | 1.33 |
| **Tenth Layer: Yellow Filter Layer** | |
| Yellow Colloidal Silver | 0.015 as silver |
| Cpd-1 | 0.16 |
| Solid Dispersion Dye ExF-5 | 0.060 |
| Solid Dispersion Dye ExF-6 | 0.060 |
| Oil-Soluble Dye ExF-7 | 0.010 |
| HBS-1 | 0.60 |

-continued

| | |
|---|---|
| Gelatin | 0.60 |
| **Eleventh Layer: Low Sensitivity Blue-Sensitive Emulsion Layer** | |
| Silver Iodobromide Emulsion J | 0.09 as silver |
| Silver Iodobromide Emulsion K | 0.09 as silver |
| ExS-7 | $8.6 \times 10^{-4}$ |
| ExC-8 | $7.0 \times 10^{-3}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |
| **Twelfth Layer: High Sensitivity Blue-Sensitive Emulsion Layer** | |
| Silver Iodobromide Emulsion L | 1.00 as silver |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| **Thirteenth Layer: First Protective Layer** | |
| UV-1 | 0.19 |
| UV-2 | 0.075 |
| UV-3 | 0.065 |
| HBS-1 | $5.0 \times 10^{-2}$ |
| HBS-4 | $5.0 \times 10^{-2}$ |
| Gelatin | 1.8 |
| **Fourteenth Layer: Second Protective Layer** | |
| Silver Iodobromide Emulsion M | 0.10 as silver |
| H-1 | 0.40 |
| B-1 (diameter: 1.7 μm) | $5.0 \times 10^{-2}$ |
| B-2 (diameter: 1.7 μm) | 0.15 |
| B-3 | 0.05 |
| S-1 | 0.20 |
| Gelatin | 0.70 |

Further, W-1 to W-3, B-4 to B-6, F-1 to F-17, iron salt, lead salt, gold salt, platinum salt, palladium salt, iridium salt and rhodium salt were appropriately included in each layer to improve storage stability, processing properties, pressure resistance, fungicidal and biocidal properties, antistatic properties and coating properties.

TABLE 7

| Emulsion | Average AgI Content (%) | Variation Coefficient of the AgI Content among Grains (%) | Average Grain Size, Equivalent-Sphere Diameter (μm) | Variation Coefficient of the Grain Size (%) | Projected Area, Equivalent-Circle Diameter (μm) | Diameter/Thickness Ratio |
|---|---|---|---|---|---|---|
| A | 1.7 | 10 | 0.46 | 15 | 0.56 | 5.5 |
| B | 3.5 | 7 | 0.57 | 20 | 0.78 | 4.0 |
| C | 8.9 | 18 | 0.66 | 17 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 13 | 0.78 | 4.0 |
| G | 8.8 | 13 | 0.61 | 17 | 0.77 | 4.4 |
| H | 8.8 | 25 | 0.61 | 23 | 0.77 | 4.4 |
| I | 8.9 | 18 | 0.84 | 18 | 1.03 | 3.7 |
| J | 1.7 | 10 | 0.46 | 15 | 0.50 | 4.2 |
| K | 8.8 | 15 | 0.64 | 19 | 0.85 | 5.2 |
| L | 14.0 | 18 | 1.28 | 19 | 1.46 | 3.5 |
| M | 1.0 | — | 0.07 | 15 | — | 1 |

In Table 7:

(1) Emulsions D, I, J, K and L were reduction sensitized during preparation of the grains using thiourea dioxide and thiosulfonic acid (XX-16) according to the examples of JP-A-2-191938.

An emulsion was prepared in the same manner except for using p-quinone in place of (XX-16).

(2) Emulsions A to L were gold, sulfur, and selenium sensitized, respectively, in the presence of the spectral sensitizing dyes which are described at each light-sensitive layer and sodium thiocyanate according to the examples of JP-A-3-237450.

(3) Low molecular weight gelatin was used in the preparation of the tabular grains according to the examples of JP-A-1-158426.

(4) In tabular grains, there were observed such dislocation lines as disclosed in JP-A-3-237450 using a high pressure electron microscope.

(5) Emulsion L comprised double structure grains containing an internal high iodide core as disclosed in JP-A-60-143331.

Preparation of Dispersion of Organic Solid Dispersion Dye

ExF-2 shown below was dispersed according to the following method. That is, 21.7 ml of water, 3 ml of a 5% aqueous solution of sodium p-octylphenoxyethoxyethoxyethanesulfonate, and 0.5 g of a 5% aqueous solution of p-octylphenoxypolyoxyethylene ether (polymerization degree: 10) were put in a pot mill having a capacity of 700 ml, and 5.0 g of Dye ExF-2 and 500 ml of zirconium oxide beads (diameter: 1 mm) were added thereto and the content was dispersed for 2 hours. The dispersion was performed using a BO-type vibrating ball mill manufactured by Chuo Koki K.K. The content was taken out after dispersion and added to 8 g of a 12.5% aqueous solution of gelatin and the beads were removed by filtration and the gelatin dispersion of the dye was obtained. The average particle size of fine particles of the dye was 0.44 μm.

Solid dispersions of ExF-3, ExF-4 and ExF-6 were obtained in the same manner. The average particle sizes of fine particles of the dyes were 0.24 μm, 0.45 μm and 0.52 μm, respectively. ExF-5 was dispersed according to the microprecipitation dispersion method disclosed in Working Example 1 of EP-A-549489. The average particle size was 0.06 μm.

ExC-1

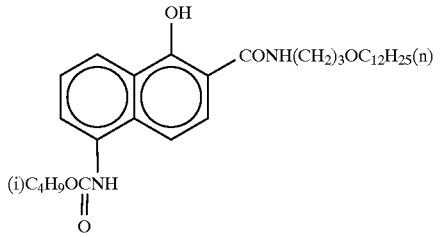

ExC-2

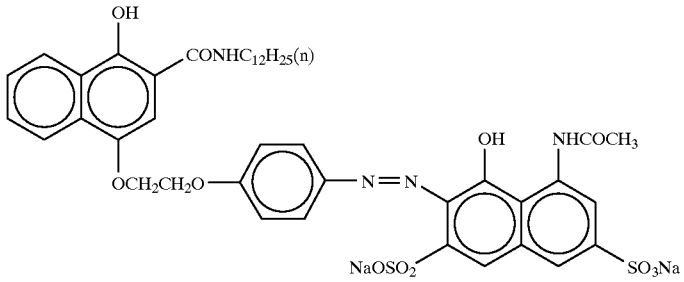

ExC-3

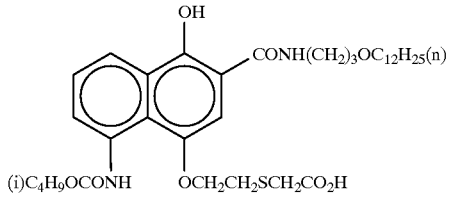

ExC-4

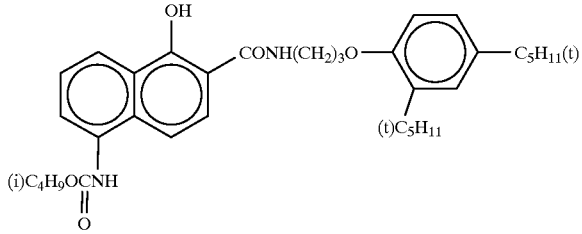

-continued
ExC-5
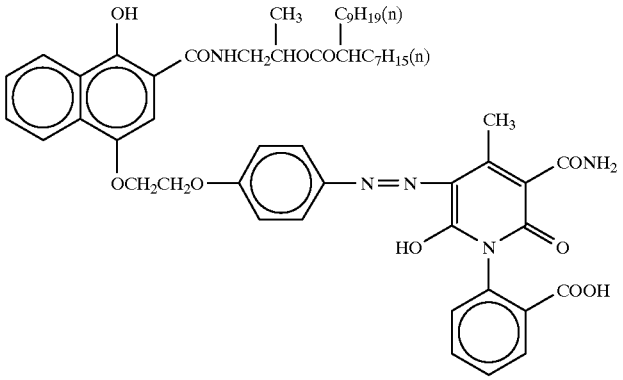
ExC-6
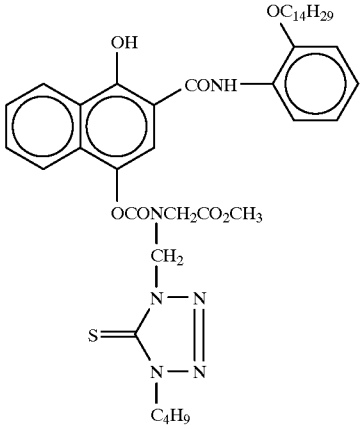
ExC-7
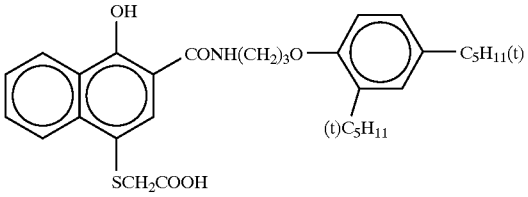
ExC-8
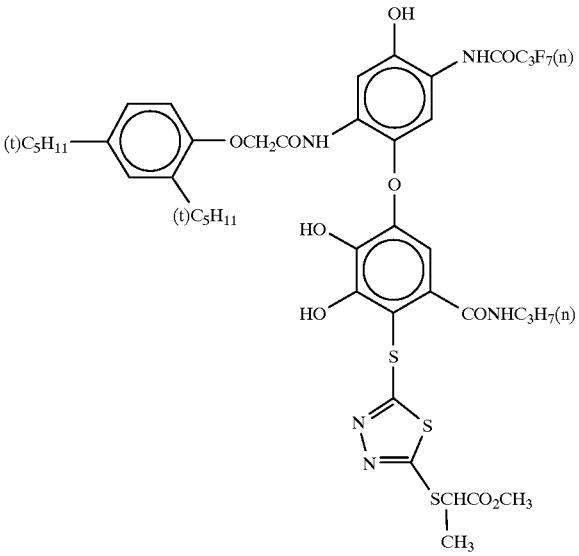

-continued
ExM-1
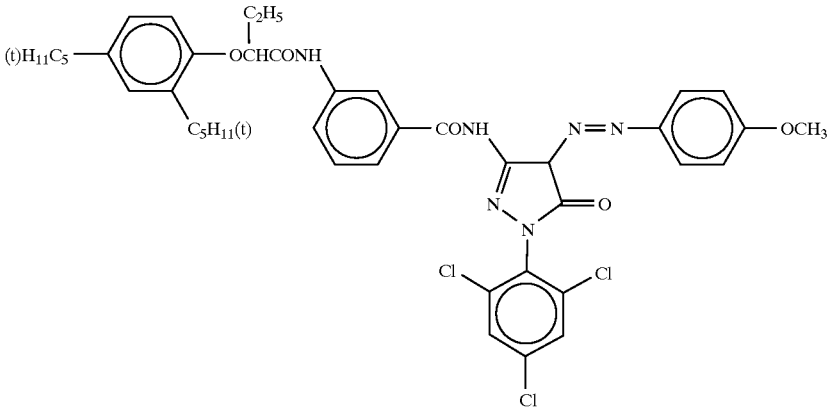
ExM-2
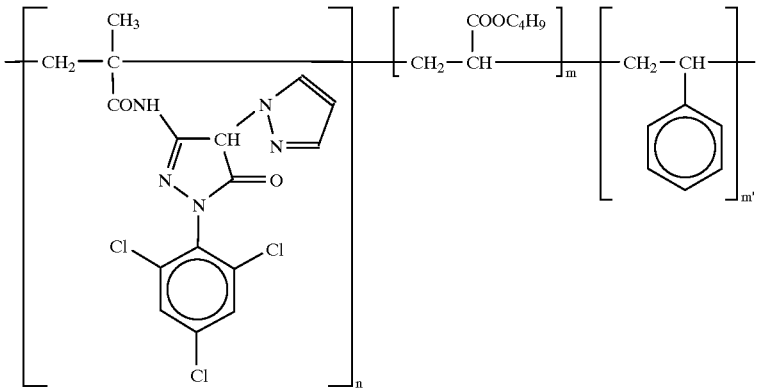
n = 50 (weight %)
m = 25 (weight %)
m' = 25 (weight %)
mol. wt.: about 20,000
ExM-3
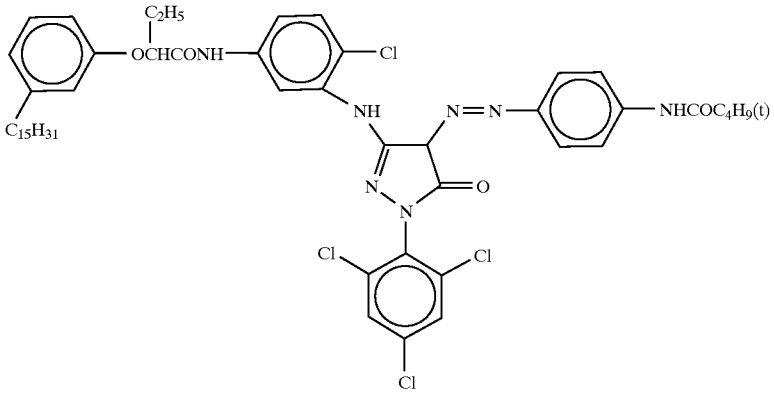
ExM-4
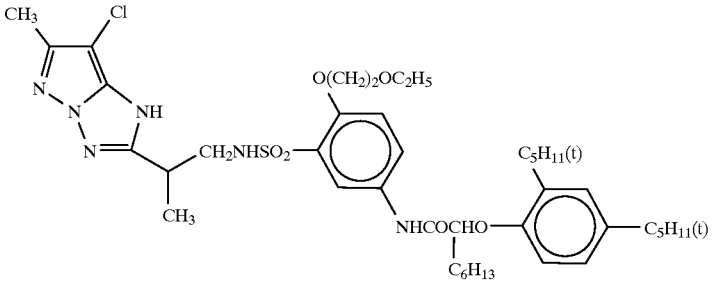

-continued
ExM-5
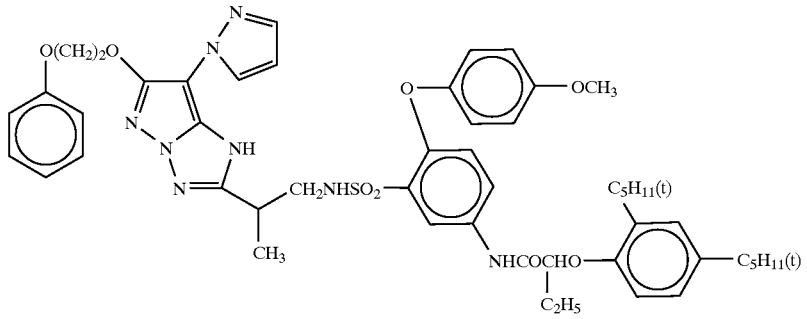
ExY-1
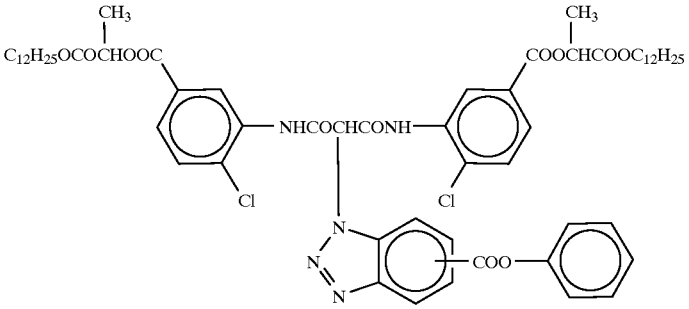
ExY-2
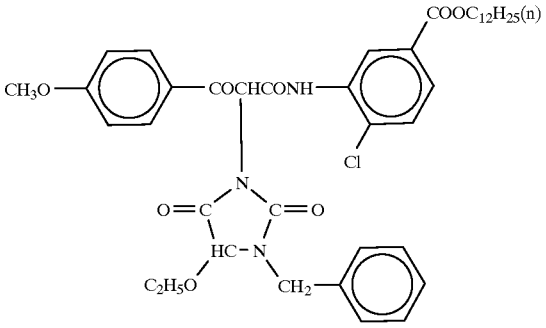
ExY-3
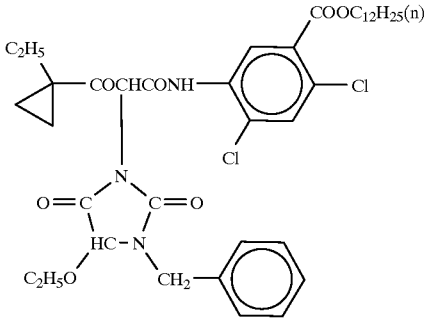

-continued
ExY-4
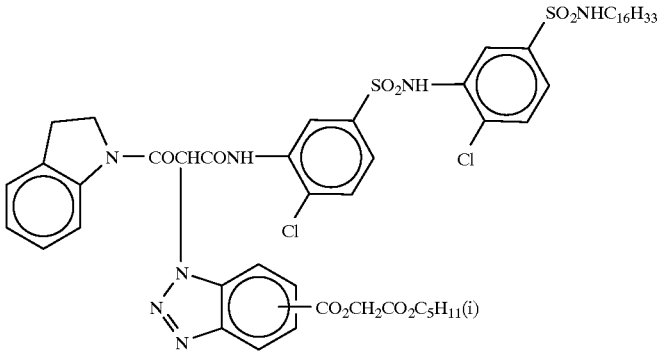
ExY-5
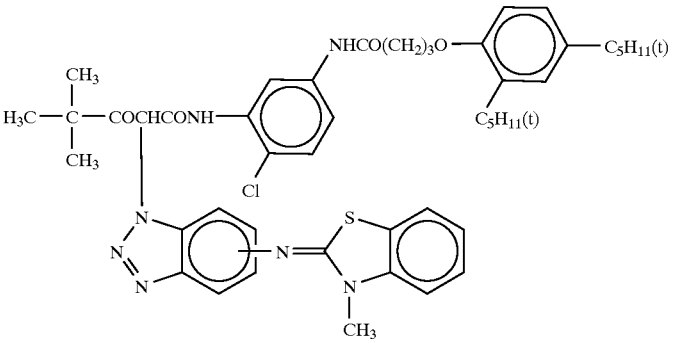
ExF-1
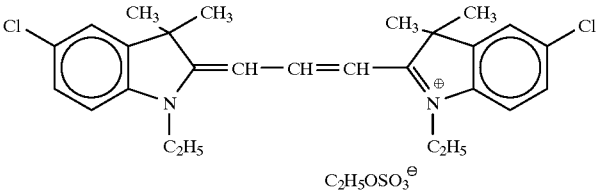
ExF-2
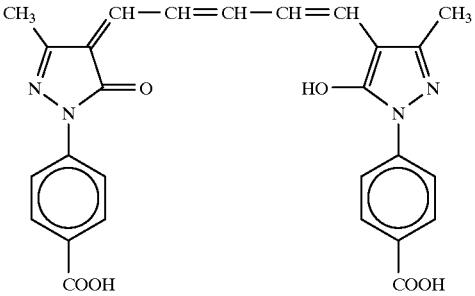
ExF-3
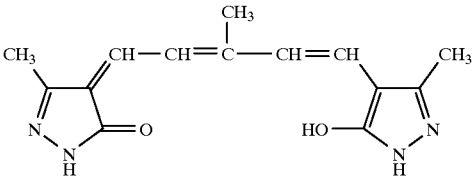

-continued
ExF-4
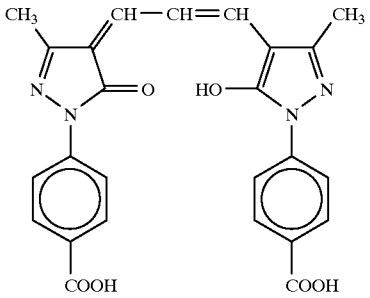
ExF-5
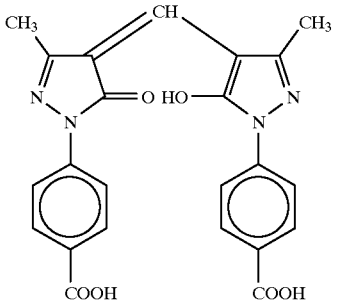
ExF-6
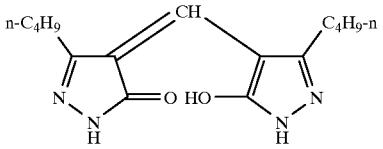
ExF-7
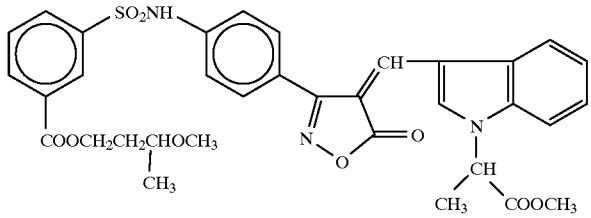
Cpd-1
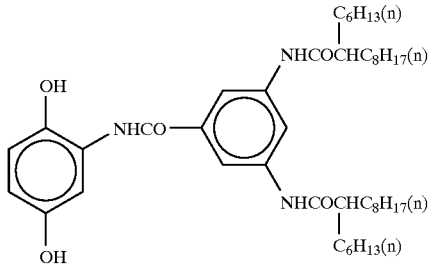
Cpd-2
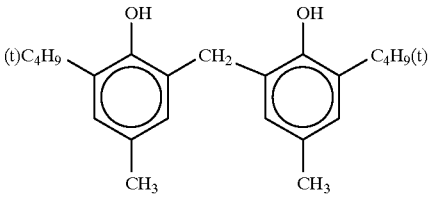

-continued
Cpd-3
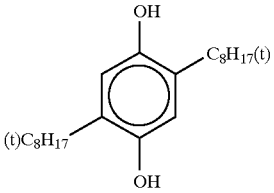
UV-1
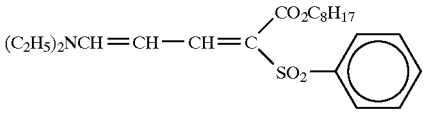
UV-2
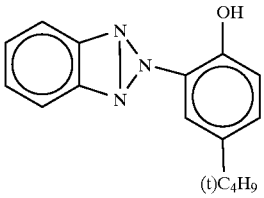
UV-3
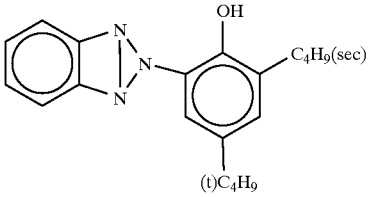
HBS-1
Tricresyl Phosphate
HBS-2
Di-n-butyl Phthalate
HBS-3
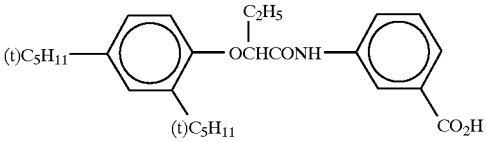
HBS-4
Tri(2-ethylhexyl) Phosphate
ExS-1
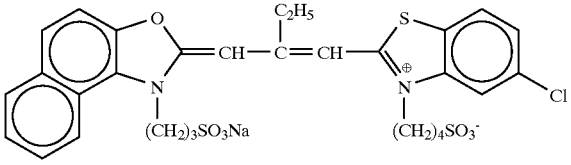
ExS-2
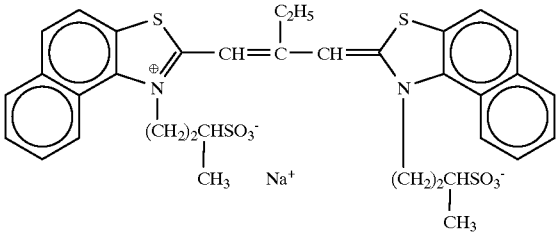

-continued
ExS-3
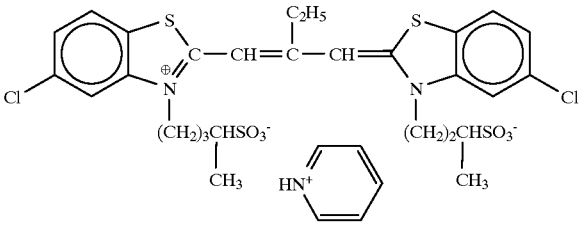
ExS-4
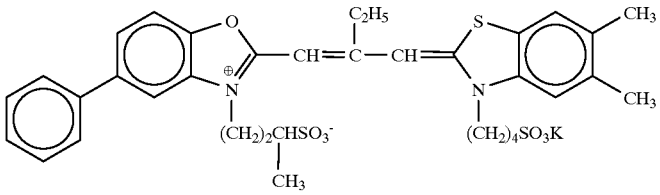
ExS-5
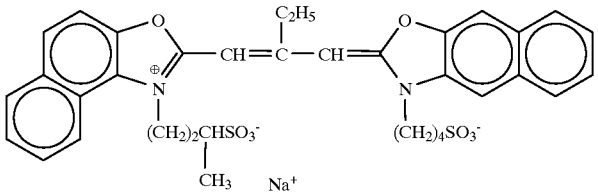
ExS-6
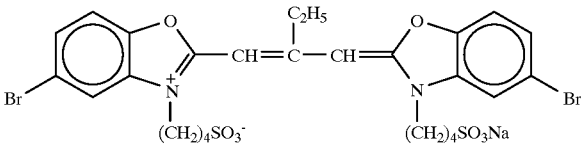
ExS-7
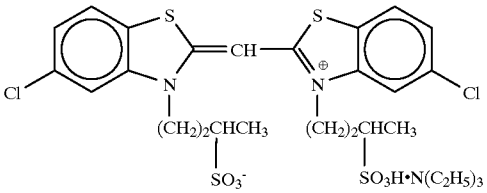
S-1
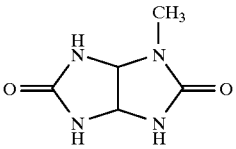
H-1
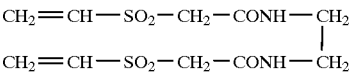
B-1
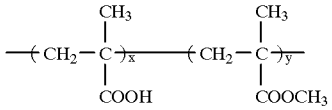
x/y = 10/90 (weight ratio)
average molecular weight:
about 35,000

-continued
B-2
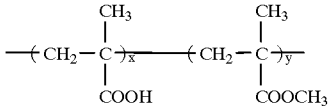
x/y = 40/60 (weight ratio)
average molecular weight:
about 20,000
B-3
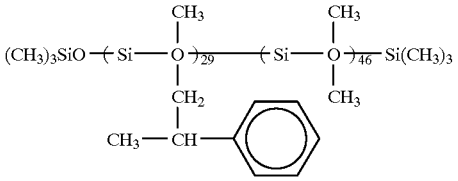
(mol ratio)
average molecular weight:
about 8,000
B-4
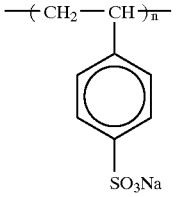
average molecular weight:
about 750,000
B-5
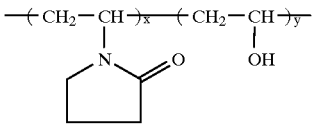
x/y = 70/30 (weight ratio)
average molecular weight:
about 17,000
B-6
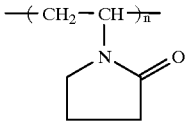
average molecular weight:
about 10,000
W-1
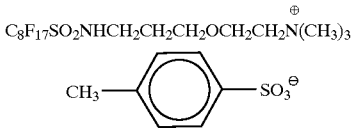
W-2
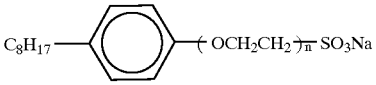
n = 2 ~ 4
W-3
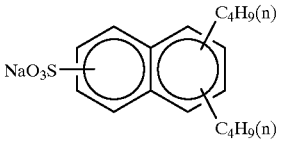

-continued
F-1
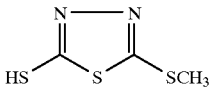
F-2
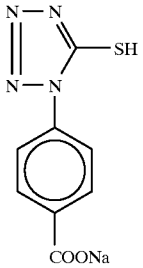
F-3
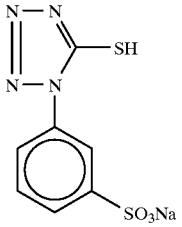
F-4
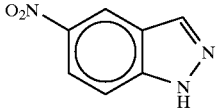
F-5
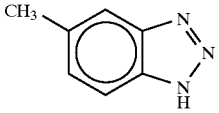
F-6
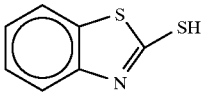
F-7
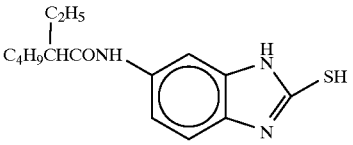
F-8
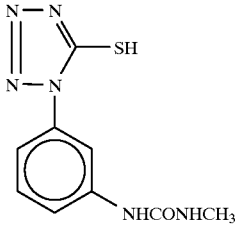
F-9
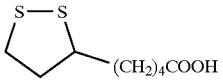

-continued

F-10

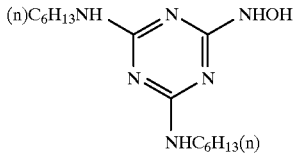

F-11

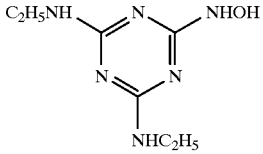

F-12

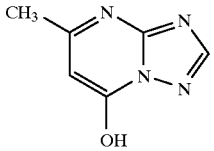

F-13

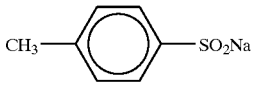

F-14

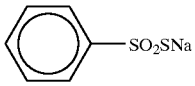

F-15

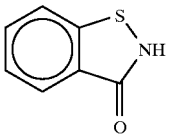

F-16

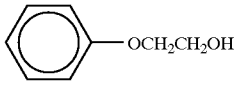

F-17

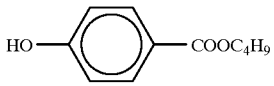

A sample was prepared using the dyes in the fifth and sixth layers shown in Table 8, (XX-16) and p-quinone, and subjected to exposure process in the same manner as in Example 1 (only SC-50 filter was not used). Sensitivity is the reciprocal of the exposure amount required to give an optical density of fog +0.1 and is shown as a relative value.

TABLE 8

| Sample No. | 5th Layer[1)] | 9th Layer[1)] | Oxidizing Agent | Cyan Sensitivity (relative value) | Magenta Sensitivity (relative value) | Cyan Fog | Magenta Fog | Remarks |
|---|---|---|---|---|---|---|---|---|
| 2001 | 109, 117 | 101 | XX-16 | 100 (control) | 100 (control) | 0.26 | 0.36 | Comparison |
| 2002 | " | 108 | " | — | 175 | — | 0.13 | Invention |
| 2003 | 116, 118 | 101 | " | 193 | — | 0.13 | — | Invention |
| 2004 | 109, 117 | 101 | p-quinone | 100 | 99 | 0.26 | 0.36 | Comparison |
| 2005 | " | 108 | " | — | 170 | — | 0.15 | Invention |
| 2006 | 116, 118 | 101 | " | 185 | — | 0.15 | — | Invention |

[1)]The dye used in each layer was changed to the dye of the emulsion number in Example 1 shown in this column.

As is apparent from Table 8, in a multilayer color film, samples in which the dyes of Emulsions 108, 116 and 118 of the present invention were used showed high sensitivity and low fog compared with comparative samples in which the dyes of Comparative Emulsion 101, 109 and 117 were used.

Further, it can be seen that as an oxidizing agent used in the preparation of reduction sensitized emulsion, thiosulfonic acid (XX-16) is preferred to p-quinone.

EXAMPLE 3

1) Support

The support which was used in the present invention was prepared as follows.

One hundred (100) weight parts of polyethylene-2,6-naphthalate polymer and 2 weight parts of Tinuvin P. 326 (product of Ciba Geigy), as an ultraviolet absorbing agent, were dried, then melted at 300° C., subsequently, extruded through a T-type die, and stretched 3.3 times in a machine direction at 140° C. and then 3.3 times in a transverse direction at 130° C., and further thermal fixed for 6 seconds at 250° C. and the PEN film having the thickness of 90 μm was obtained. Appropriate amounts of blue dyes, magenta dyes and yellow dyes were added to this PEN film (I-1, I-4, I-6, I-24, I-26, I-27 and II-5 disclosed in Kokai-Giho, Kogi No. 94-6023). Further, the film was wound on to a stainless steel spool having a diameter of 20 cm and provided heat history at 110° C. for 48 hours to obtain a support reluctant to get curling habit.

2) Coating of Undercoat Layer

After both surfaces of the above support were subjected to corona discharge, UV discharge and glow discharge treatments, on one side of the support an undercoat solution having the following composition was coated (10 cc/m$^2$, using a bar coater): 0.1 g/m$^2$ of gelatin, 0.01 g/m$^2$ of sodium α-sulfo-di-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of polyamide-epichlorohydrin polycondensation product. The undercoat layer was provided on the hotter side at the time of stretching. Drying was conducted at 115° C. for 6 minutes (the temperature of the roller and transporting device of the drying zone was 115° C.).

3) Coating of Backing Layer

On the side of the above undercoated support opposite to the side having been coated with the undercoat solution, an antistatic layer, a magnetic recording layer and a sliding layer having the following compositions were coated as backing layers.

3-1) Coating of Antistatic Layer

Zero point two (0.2) gram/m$^2$ of a dispersion of fine particle powder of a stannic oxide-antimony oxide composite having the average particle size of 0.005 μm and specific resistance of 5 Ω·cm (the particle size of the second agglomerate: about 0.08 μm), 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree: 10) and resorcin were coated.

3-2) Coating of Magnetic Recording Layer

Zero point zero six (0.06) gram/m$^2$ of cobalt-γ-iron oxide which was coating-treated with 3-polyoxyethylene-propyloxytrimethoxysilane (polymerization degree: 15) (15 wt %) (specific surface area: 43 m$^2$/g, major axis: 0.14 μm, minor axis: 0.03 μm, saturation magnetization: 89 emu/g, $Fe^{+2}/Fe^{+3}$ is 6/94, the surface was treated with 2 wt %, respectively, based on the iron oxide, of aluminum oxide and silicon oxide), 1.2 g/m$^2$ of diacetyl cellulose (dispersion of the iron oxide was carried out using an open kneader and a sand mill) and 0.3 g/m$^2$ of $C_2H_5C[CH_2OCONH{-}C_6H_3(CH_3)NCO]_3$ as a curing agent, with acetone, methyl ethyl ketone and cyclohexanone as solvents, were coated with a bar coater to obtain a magnetic recording layer having the film thickness of 1.2 μm. Ten (10) mg/m$^2$ of silica particles (0.3 μm) as a matting agent and 10 mg/m$^2$ of an aluminum oxide abrasive (0.15 μm) coating-treated with 3-polyoxyethylene-propyloxytrimethoxysilane (polymerization degree: 15) (15 wt %) were added. Drying was conducted at 115° C. for 6 minutes (the temperature of the roller and transporting device of the drying zone was 115° C.). The increase of the color density of DB of the magnetic recording layer by X-light (a blue filter) was about 0.1, and saturation magnetization moment of the magnetic recording layer was 4.2 emu/g, coercive force was $7.3\times10^4$ A/m, and rectangular ratio was 65%. For comparison, a sample not being provided with a magnetic recording layer was also prepared.

3-3) Preparation of Sliding Layer

A mixture of diacetyl cellulose (25 mg/m$^2$), $C_6H_{13}CH(OH)C_{10}H_{20}COOC_{40}H_{81}$ (Compound a, 6 mg/m$^2$) and $C_{50}H_{101}O(CH_2CH_2O)_{16}H$ (Compound b, 9 mg/m$^2$) was coated. This mixture was melted in xylene/propylene glycol monomethyl ether (1/1 by volume) by heating at 105° C., and the solution was poured into propylene glycol monomethyl ether (10 time amount) at room temperature and dispersed, and the dispersion was further dispersed in acetone (average particle size: 0.01 μm) and then added to the coating solution. Fifteen (15) mg/m$^2$ of silica particles (0.3 μm) as a matting agent and 15 mg/m$^2$ of an aluminum oxide abrasive (0.15 μm) coating-treated with 3-polyoxyethylene-propyloxytrimethoxysilane (polymerization degree: 15) (15 wt %) were added. Drying was conducted at 115° C. for 6 minutes (the temperature of the roller and transporting device of the drying zone was 115° C.). The thus-obtained sliding layer showed excellent characteristics of dynamic friction coefficient of 0.06 (a stainless steel hard ball of 5 mmφ, load: 100 g, speed: 6 cm/min), static friction coefficient of 0.07 (a clip method), and dynamic friction coefficient of 0.12 between the surface of the emulsion described below and the sliding layer.

4) Coating of Light-sensitive Layer

Next, samples were prepared in the same manner as in Example 2 except that the dyes were changed by multilayer coating each light-sensitive layer on the opposite side of the above obtained backing layer. That is, samples in which dyes in the fifth and ninth layers were changed to the dyes of Sample 2001 in Table 8 in Example 2 were Sample 3001 (having a magnetic recording layer) and Sample 3003 (not having a magnetic recording layer), and samples in which dyes in the fifth layer were changed to the dyes of the fifth layer of Sample 2003 in Table 8 and the dyes of the ninth layer were changed to the dyes of the ninth layer of Sample 2002 in Table 8 were Sample 3002 (having a magnetic recording layer) and Sample 3004 (not having a magnetic recording layer).

The thus prepared photographic material was cut to a size of 24 mm in width and 160 cm in length, and two perforations of 2 mm square at an interval of 5.8 mm were provided 0.7 mm inside from one side width direction in the length direction of the photographic material. The sample provided with this set of two perforations at intervals of 32 mm was prepared and encased in the film cartridge made of plastics as explained in FIG. 1 to FIG. 7 in U.S. Pat. No. 5,296,887.

FM signals were recorded between the above perforations of the sample from the side of the support having the magnetically recording layer using a head capable of in and out of 2,000 turns with head gap of 5 μm at a feed rate of 1,000 mm/s.

After FM signals were recorded, the emulsion surface was subjected to entire and uniform exposure of 1,000 cms and each process was conducted according to the following method, and each sample was put in the above plastic film cartridge again.

Sample 3001 and 3002 were subjected to exposure in the same manner as in Example 1 (only SC-50 filter was not used), then to the following processing (running processing) and evaluated as in Example 2.

Each processing was conducted using an automatic processor FP-360B manufactured by Fuji Photo Film Co., Ltd. according to the following step. Further, the processor was modified so that the overflow from the bleaching bath was discharged to the waste solution tank not to flow to the after bath. FP-360B processor carried the evaporation compensating means disclosed in Hatsumei Kyokai Kokai Giho No. 94-4992.

The processing step and the composition of each processing solution are as follows.

Processing Step

| Step | Processing Time | Processing Temperature (° C.) | Replenishment Rate* (ml) | Tank Capacity (liter) |
|---|---|---|---|---|
| Color Development | 3 min 5 sec | 37.8 | 20 | 11.5 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Washing | 30 sec | 38.0 | 17 | 3 |
| Stabilization (1) | 20 sec | 38.0 | — | 3 |
| Stabilization (2) | 20 sec | 38.0 | 15 | 3 |
| Drying | 1 min 30 sec | 60 | | |

*Replenishment rate: per 1.1 meter of 35 mm wide photographic material (corresponding to a 24 ex. film)

Stabilization and fixing were conducted in a countercurrent system from (2) to (1), and the overflow from the washing tank was all introduced into the fixing tank (2). Further, the amount of carryover of the developing solution into the bleaching step, the amount of carryover of the bleaching solution to the fixing step, and the amount of carryover of the fixing solution to the washing step were 2.5 ml, 2.0 ml and 2.0 ml per 1.1 meter of 35 mm wide photographic material, respectively. Further, the crossover time was 6 seconds in each case, and this time is included in the processing time of the previous step.

Open areas of the above processor were 100 $cm^2$ with the color developing solution, 120 $cm^2$ with the bleaching solution and about 100 $cm^2$ with each of other processing solutions.

The composition of each processing solution is described below.

| | Tank Solution (g) | Replenisher (g) |
|---|---|---|
| Color Developing Solution | | |
| Diethylenetriaminepentaacetic Acid | 3.0 | 3.0 |
| Disodium Catechol-3,5-disulfonate | 0.3 | 0.3 |
| Sodium Sulfite | 3.9 | 5.3 |
| Potassium Carbonate | 39.0 | 39.0 |
| Disodium N,N-Bis(2-sulfonato-ethyl)hydroxylamine | 1.5 | 2.0 |
| Potassium Bromide | 1.3 | 0.3 |
| Potassium Iodide | 1.3 mg | — |
| 4-Hydroxy-6-methyl-1,3,3a,7-tetraazaindene | 0.05 | — |
| Hydroxylamine Sulfate | 2.4 | 3.3 |
| 2-Methyl-4-[N-ethyl-N-(β-hydroxy-ethyl)amino]aniline Sulfate | 4.5 | 6.5 |
| Water to make | 1.0 l | 1.0 l |
| pH (adjusted with potassium hydroxide and sulfuric acid) | 10.05 | 10.18 |

-continued

| | Tank Solution (g) | Replenisher (g) |
|---|---|---|
| Bleaching Solution | | |
| Ammonium 1,3-Diaminopropanetetra-acetato Ferrate Monohydrate | 113 | 170 |
| Ammonium Bromide | 70 | 105 |
| Ammonium Nitrate | 14 | 21 |
| Succinic Acid | 34 | 51 |
| Maleic Acid | 28 | 42 |
| Water to make | 1.0 l | 1.0 l |
| pH (adjusted with aqueous ammonia) | 4.6 | 4.0 |
| Fixing (1) Tank Solution | | |
| The mixed solution of 5/95 mixture (volume ratio) of the above bleaching tank solution and the following fixing tank solution (pH: 6.8) | | |
| Fixing (2) Tank Solution | | |
| Aqueous Ammonium Thiosulfate Solution (750 g/liter) | 240 ml | 720 ml |
| Imidazole | 7 | 21 |
| Ammonium Methanethiosulfonate | 5 | 15 |
| Ammonium Methanesulfinate | 10 | 30 |
| Ethylenediaminetetraacetic Acid | 13 | 39 |
| Water to make | 1.0 l | 1.0 l |
| pH (adjusted with aqueous ammonia and acetic acid) | 7.4 | 7.45 |

Washing Water

City water was passed through a mixed bed column packed with an H-type strongly acidic cation exchange resin (Amberlite IR-120B of Rohm & Haas) and an OH-type strongly basic anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

Stabilizing Solution (replenisher equals tank solution)

| | (unit: g) |
|---|---|
| Sodium p-Toluenesulfinate | 0.03 |
| Polyoxyethylene-p-monononylphenyl Ether (average polymerization degree: 10) | 0.2 |
| Sodium 1,2-Benzisothiazolin-3-one | 0.10 |
| Disodium Ethylenediaminetetraacetate | 0.05 |
| 1,2,4-Triazole | 1.3 |
| 1,4-Bis(1,2,4-triazol-1-ylmethyl)-piperazine | 0.75 |
| Water to make | 1.0 l |
| pH | 8.5 |

The results of evaluation was shown in Table 9. As is apparent from the results in Table 9, Samples 3002 and 3004 according to the present invention were high sensitivity and low fog compared with Comparative Samples 3001 and 3003.

When the presence or absence of the magnetic recording layer was compared, there was almost no difference between Comparative Samples 3001 and 3003, while as to Samples 3002 and 3004 using the dyes of the present invention, Sample 3002 having a recording layer were higher sensitive and generated lower fog.

TABLE 9

| Sample No. | 5th Layer | 9th Layer | Magnetic Recording Layer | Cyan Sensitivity (relative value) | Magenta Sensitivity (relative value) | Cyan Fog | Magenta Fog | Remarks |
|---|---|---|---|---|---|---|---|---|
| 3001 | 109, 117 | 101 | present | 100 (control) | 100 (control) | 0.27 | 0.31 | Comparison |
| 3002 | 116, 118 | 108 | present | 161 | 164 | 0.12 | 0.14 | Invention |
| 3003 | 119, 117 | 101 | absent | 100 | 102 | 0.27 | 0.31 | Comparison |
| 3004 | 116, 118 | 108 | absent | 153 | 158 | 0.14 | 0.16 | Invention |

EFFECT OF THE INVENTION

A silver halide photographic material which is high sensitive and excellent in storage stability can be obtained according to the present invention.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a support having provided thereon at least one silver halide emulsion layer, wherein silver halide grains of said emulsion layer have been subjected to reduction sensitization and contain at least one compound represented by the following formula (I):

(I)

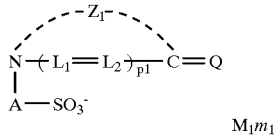

$M_1m_1$ wherein A represents a divalent linking group having at least one atom other than a carbon atom; $Z_1$ represents an atomic group necessary for forming a 5- or 6-membered nitrogen-containing heterocyclic ring; $L_1$ and $L_2$ each represents a methine group; $p_1$ represents 0 or 1; $M_1$ represents a counter ion for balancing a charge; $m_1$ represents a number of from 0 to 10 necessary for neutralizing a charge in the molecule; and Q represents a group necessary to form a methine dye.

2. The silver halide photographic material as claimed in claim 1, wherein A in the compound represented by formula (I) is represented by $A_1$ or $A_2$:

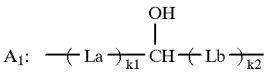

-continued

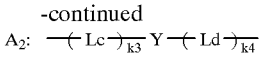

wherein La, Lb, Lc and Ld each represents a methylene group; $k_1$, $k_2$, $k_3$ and $k_4$ each represents an integer of from 0 to 10; and Y represents an oxygen atom or a sulfur atom.

3. The silver halide photographic material as claimed in claim 1, which contains at least one compound represented by the following formula (XX), (XXI) or (XXII):

(XX)

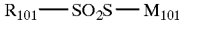

(XXI)

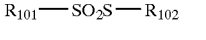

(XXII)

wherein $R_{101}$, $R_{102}$ and $R_{103}$ each represents an aliphatic group, an aromatic group or a heterocyclic group; $M_{101}$ represents a cation; E represents a divalent linking group, and a represents 0 or 1.

4. The silver halide photographic material as claimed in claim 1, which further comprises a transparent magnetic recording layer.

5. The silver halide photographic material as claimed in claim 1, wherein said at least one compound represented by formula (I) is added in an amount of from $0.5\times10^{-6}$ mol to $1.0\times10^{-2}$ mol per mol of the silver halide.

6. The silver halide photographic material as claimed in claim 1, wherein the reduction sensitization is carried out by using an ascorbic acid or a derivative thereof as a reduction sensitizer.

7. The silver halide photographic material as claimed in claim 3, wherein said at least one compound represented by formula (XX), (XXI) or (XXII) is added in an amount of from $10^{-7}$ to $10^{-1}$ mol per mol of the silver halide.

* * * * *